US006501038B2

(12) United States Patent
Hayashi et al.

(10) Patent No.: US 6,501,038 B2
(45) **Date of Patent: *Dec. 31, 2002**

(54) KEY SWITCH AND KEYBOARD

(75) Inventors: Kazutoshi Hayashi, Tokyo (JP); Toshiaki Tanaka, Tokyo (JP); Junichi Maruyama, Tokyo (JP); Goro Watanabe, Kawasaki (JP)

(73) Assignees: Fujitsu Takamisawa Component Limited, Tokyo (JP); Fujitsu Limited, Kawasaki (JP)

( * ) Notice: Subject to any disclaimer, the term of this patent is extended or adjusted under 35 U.S.C. 154(b) by 75 days.

This patent is subject to a terminal disclaimer.

(21) Appl. No.: 09/729,982

(22) Filed: Dec. 6, 2000

(65) Prior Publication Data

US 2001/0002647 A1 Jun. 7, 2001

(30) Foreign Application Priority Data

Dec. 7, 1999 (JP) ..... 11-347887

(51) Int. Cl.[7] ..... H01H 13/70
(52) U.S. Cl. ..... 200/344
(58) Field of Search ..... 200/5 A, 512, 200/517, 344, 345; 361/680–682; 400/490, 491.2, 495, 495.1, 496

(56) References Cited

U.S. PATENT DOCUMENTS

| | | | | |
|---|---|---|---|---|
| 5,268,545 A | * 12/1993 | Bruner | ..... | 200/329 |
| 5,466,901 A | * 11/1995 | Mochizuki | ..... | 200/344 |
| 5,793,605 A | * 8/1998 | Sellers | ..... | 200/344 |
| 5,813,521 A | * 9/1998 | Koike et al. | ..... | 200/344 |
| 5,874,696 A | * 2/1999 | Hayashi et al. | ..... | 200/345 |
| 5,971,637 A | * 10/1999 | Malhi et al. | ..... | 361/680 |
| 6,118,092 A | * 9/2000 | Hayashi | ..... | 200/344 |
| 6,257,782 B1 | * 7/2001 | Maruyama et al. | ..... | 200/345 |

FOREIGN PATENT DOCUMENTS

| | | | | |
|---|---|---|---|---|
| JP | 6-17057 | 3/1994 | ..... | H01H/13/20 |
| JP | 8-279316 | 10/1996 | ..... | H01H/13/20 |
| JP | 9-63403 | 3/1997 | ..... | H01H/13/14 |
| JP | 10-334760 | 12/1998 | ..... | H01H/13/14 |

* cited by examiner

*Primary Examiner*—Michael Friedhofer
(74) *Attorney, Agent, or Firm*—Staas & Halsey LLP

(57) ABSTRACT

A key switch comprising a base, a key top arranged above the base, a pair of link members interlocked to each other and operatively engaged with the base and the key top to support the key top above the base and direct the key top in a vertical direction, and a switching mechanism for selectively opening and closing an electric circuit in connection with a vertical movement of the key top. Each of the link members includes a sliding portion slidably and shiftably engaged with either one of the base and the key top. At least one plate spring is disposed between at least one of the link members and either one of the base and the key top with which the sliding portion is engaged, to exert a biasing force, relative to a shifting amount of the sliding portion, onto at least one of the link members in a direction different from the vertical direction. The plate spring includes, in an integral manner, a first spring portion extending along a fixed-end side in a direction substantially parallel to a shifting direction of the sliding portion of each link member and a second spring portion extending along a free-end side in a direction intersecting the first spring portion.

20 Claims, 24 Drawing Sheets

KEY SWITCH AND KEYBOARD

BACKGROUND OF THE INVENTION

1. Field of the Invention

The present invention relates generally to a switch mechanism for key-entry operation and, more particularly, to a key-entry switch (hereinafter referred to as a key switch) preferably used for a keyboard incorporated as an input device in electronic equipment. The present invention also relates to a relatively thin keyboard provided with a plurality of key switches.

2. Description of the Related Art

In the technical field of portable electronic equipment such as notebook-size personal computers or word processors, etc., various techniques have been provided to facilitate a reduction in height or thickness of an equipment housing including a keyboard and to improve the portability of the equipment. Particularly, when the height of a keyboard provided with a plurality of key switches is to be reduced, it has been generally required to maintain the stroke of each key switch at a predetermined distance to ensure constant operational properties thereof and, simultaneously, to reduce the entire height of the key switch upon both the non-operated (or switched-off) and operated (or pushed down and switched-on) condition thereof.

There has been known a conventional key switch, for use in such a relatively thin keyboard, which includes a base, a key top disposed above the base, a pair of link members for supporting the key top above the base and directing it in the vertical or up-and-down direction, and a switching mechanism for opening and closing contacts of an electric circuit in correspondence to the vertical or up-and-down movement of the key top. The pair of link members are interlocked to each other, each being operatively engaged with both the base and the key top so as to allow the key top to be moved in a parallel displacement in a substantially vertical direction in relation to the major surface of the base, while keeping a predetermined posture of the key top. The switching mechanism comprises a sheet-like switch disposed beneath the base, and an elastic actuating member which is disposed between the key top and the sheet-like switch and which operates so as to close the contacts in the sheet-like switch as the key top is moved downward.

As the elastic actuating member, in general, a dome-like member integrally formed from a rubber material is widely employed. When no external force is applied to the key top, the dome-like elastic actuating member supports the key top on the outer surface of the dome upper end, and urges the key top toward an initial position vertically upwardly away from the base. When the key top is pushed downward by a key-entry operation, the elastic actuating member is elastically deformed while exerting a biasing or an elastic restoring force to the key top in an opposite direction. In this condition, a protrusion formed on the interior surface of the dome upper end serves to push a pair of contacts in the sheet-like switch from its outer surface, so as to close or turn-on the sheet-like switch. When the downward pushing force applied to the key top is released, the elastic actuating member is elastically restored, so as to return the key top to the initial position and to open or turn-off the contacts in the sheet-like switch.

The dome-like elastic actuating member can exert, when it is elastically deformed by a key-entry operation, a biasing or an elastic restoring force to the key top, which assumes non-linear relationship with a displacement of the key top due to its dome-shaped profile. That is, the key switch can establish such a key-entry operating properties that at the instant when the pushed-down displacement of the key top exceeds a predetermined value, the biasing force, which has been gradually increased until that time, is sharply reduced. As a result, an operator can easily recognize that the key switch has been correctly and appropriately operated, by finger pressure, even when the keyboard is one adapted to be incorporated in a portable electronic equipment in which the key switch generally has a relatively short keying stroke. The dome-shaped elastic actuating member is, however, held in a location between the key top and the sheet-like switch and interposed therebetween in relation to the height of the key switch, regardless of the degree of the deformation of the actuating member. Therefore, the dome-shaped elastic actuating member in itself affects the entire height of the key switch upon both the inoperated and operated condition thereof, and thus tends to become a major factor that hinders further reduction in the height or thickness of the key switch, and hence of the keyboard. An alternative construction of the dome-shaped elastic actuating member has, therefore, been proposed which does not affect the entire height of the key switch in both the inoperated and operated condition thereof.

For example, Japanese Unexamined Patent Publication (Kokai) No. 10-334760 (JP-A-10-334760) discloses one example of a key switch in which at least one of a pair of frame-like link members and a base supporting these link members is formed from an elastic material such as a thin elastic metal sheet. The pair of link members are elastically supported between the base and the key top by a cantilever spring formed on the lower end portion of at least one of the frame-like link members, or on at least one of the supporting portion of the base supporting the lower end portion of the frame. When the key top is pushed down by a key-entry operation, a horizontal displacement of the lower end portion of the frame-like link member causes the deflection of the cantilever spring, and produces an elastic restoring force, which is transmitted via the link members to the key top and exerts a biasing force, onto the key top, upwardly and toward the initial position. In this construction, another cantilever spring is formed at one of the link members for pushing the pair of contacts in the sheet-like switch, thus eliminating the dome-shaped elastic actuating member.

The cantilever spring which is used as the key top biasing means, as described above, is thought to contribute to the reduction of the entire height of key switch in both the inoperated and operated condition thereof, since, unlike the dome-shaped elastic actuating member, it is not interposed between the key top and the sheet-like switch in relation to the height of the key switch. This cantilever spring, however, produces the elastic restoring force mainly in generally flat spring portion between the proximal end connected to the link member or the base and the free distal end thereof. As the key top moves downward, the generally flat spring portion of the cantilever spring is deflected in substantially the same direction as the shifting mortion of the lower end portion of the frame-like link member. Thus, the length of the spring portion of the cantilever spring is relatively short corresponding to the width (in the direction perpendicular to the shifting direction) of the lower end portion of the frame-like link member.

With this construction, in order to reduce the dimension of the key switch, it is required to reduce the dimension of the cantilever spring, and hence to shorten the length of the spring portion thereof. As a result, among key switches having different dimensions, the elastic restoring force of a key switch having a smaller dimension tends to be unnecessarily increased for the same amount of deformation, that is, for substantially same length of depressed key stroke, compared to a key switch having a greater dimension. Thus, there arises a problem that the size reduction of a key switch entails an unnecessary increase in the elastic biasing force exerted onto the key top toward the initial position, and adversely affects the key-entry operating properties. In addition, the degradation of the durability of the cantilever spring, due to the increased bending stress, is also of concern.

In order to achieve the desired key entry operating properties, it is required, of the cantilever spring as the key top biasing means, that it exerts, in cooperation with the link members, a biasing force which assumes the same non-linear relationship with a displacement of the key top as the dome-shaped elastic actuating member. In order to satisfy this requirement, it is advantageous that the cantilever spring has some degree of freedom in design, that is, the optimal dimension and geometry of the cantilever spring for exerting a desired biasing force can be selected from a range of values. With the above construction, however, a size reduction of the key switch entails a size reduction of the cantilever spring so that the design freedom is also decreased and it may become difficult to exert a desired biasing force, onto the key top, in a non-linear relationship with the displacement of the key top.

There has been known a key switch having the above described construction in which each of the pair of link members have, at one end region thereof, an engaging shaft portion rotatably or slidably engaged with the base, and at the other end region thereof, an engaging shaft rotatably or slidably engaged with the key top. In this construction, the base and the key top have both bearing portions formed thereon for receiving individually the respective engaging shaft of the link members. In this case, the engaging shafts are required to rotate or slide smoothly in respective bearing portions. In the case where an unnecessary gap is formed between the bearing portion of the key top and the engaging shaft of the link member due to the dimensional errors in the shaping of the key top and the link member, there arises a fluctuation of the key top during key-entry operation. Especially when the key top is in the initial position, that is, in the uppermost position in the key-entry stroke, the fluctuation of the key top with respect to the link member may cause the key top to be inclined from the normal position when the key top is pushed down by an operator, and cause the contacts in the sheet-like switch to be pushed down incorrectly. If the machining precision is to be increased, with a smaller tolerance for the key top and the link member, to avoid this problem, the production cost of the key switch may be increased.

SUMMARY OF THE INVENTION

It is therefore an object of the present invention to provide a key switch, using a pair of link members as supporting/directing means for the key top, in which a simple and inexpensive construction permits further reduction of the entire height of the key switch in both the inoperated and operated conditions, and eliminates the dome-shaped elastic actuating member without impairing the non-linear key-entry operating properties of the key switch, and which can avoid an unnecessary increase of the biasing force elastically biasing the key top toward the initial position when the dimension of the key switch is reduced.

It is another object of the present invention to provide a key switch, using a pair of link members as supporting/directing means for the key top, in which the fluctuation of the key top with respect to the link members is reduced as much as possible without requiring high dimensional precision for the key top and the link members.

It is a further object of the present invention to provide a keyboard, provided with a plurality of key switches as described above, in which a further reduction in the height or thickness, as well as an improvement in portability and improvement in key-entry operability, are achieved.

In accordance with the present invention, there is provided a key switch comprising a base; a key top arranged above the base; a pair of link members interlocked to each other and operatively engaged with the base and the key top to support the key top above the base and direct the key top in a vertical direction, each of the link members including a sliding portion slidably and shiftably engaged with either one of the base and the key top; at least one plate spring disposed between at least one of the link members and either one of the base and the key top with which the sliding portion is engaged, to exert a biasing force, relative to a shifting amount of the sliding portion, onto the at least one of the link members in a direction different from the vertical direction, each of the at least one plate spring including, in an integral manner, a first spring portion extending along a fixed-end side in a direction substantially parallel to a shifting direction of the sliding portion of each link member and a second spring portion extending along a free-end side in a direction intersecting the first spring portion; and a switching mechanism for selectively opening and closing an electric circuit in connection with a vertical movement of the key top.

At least one plate spring may be fixed, at a proximal end of the first spring portion, to the at least one of the link members and abutted at a part of the second spring portion onto the base.

Alternatively, at least one plate spring may be fixed, at a proximal end of the first spring portion, to the base and abutted at a part of the second spring portion onto the at least one of the link members.

The base may include a fixed base element engaged with the pair of link members and a movable base element disposed under the fixed base element in such a manner as to be movable with relation to the fixed base element.

In this arrangement, at least one plate spring may be fixed at a proximal end of the first spring portion to the at least one of the link members and abutted at a part of the second spring portion onto the movable base element.

Alternatively, at least one plate spring may be fixed at a proximal end of the first spring portion to the movable base element and abutted at a part of the second spring portion onto the at least one of the link members.

In one aspect of the invention, the pair of link members are arranged to mutually intersect and are pivotably connected relative to each other at an intersection thereof. In this aspect, a first one of the link members is slidably engaged at one end region thereof with the base and rotatably engaged at another end region thereof with the key top, the sliding portion being provided on the one end region of the first link member, and a second one of the link members is engaged rotatably at one end region thereof with the base and slidably at another end region thereof with the key top, the sliding portion being provided on the other end region of the second link member.

In another aspect of the invention, the pair of link members are arranged to mutually intersect and are pivotably and slidably connected relative to each other at an intersection thereof. In this aspect, each of the link members is slidably engaged at one end region thereof with the base and rotatably engaged at another end region thereof with the key top, the sliding portion being provided on the one end region of each link member.

In further aspect of the invention, the pair of link members are meshed with each other at a toothed end of each of the link members. In this aspect, each of the link members is slidably engaged at one end region thereof with the base and rotatably engaged at another end region thereof with the key top, the sliding portion being provided on the one end region of each link member, the toothed end being provided adjacent to the other end region of each link member.

The present invention also provides a key switch comprising a base; a key top arranged above the base; a pair of link members interlocked to each other and operatively engaged with the base and the key top to support the key top above the base and direct the key top in a vertical direction, each of the link members including an axle engaged with the key top and an extension provided adjacent to the axle; and a switching mechanism for selectively opening and closing an electric circuit in connection with a vertical movement of the key top; wherein the link members are arranged in such a manner that, when the key top is in an upper limit position of a key-entry stroke, extensions provided in the link members are substantially in contact with the key top at respective areas extending further than the distance between axles of the link members.

It is preferred that the extension comprises an elastic member.

In one aspect of the invention, the pair of link members are arranged to mutually intersect and are meshed with each other at an intersection thereof. In this aspect, each of the link members is engaged slidably at one end region thereof with the base and rotatably at another end region thereof with the key top, a second axle being provided on the one end region of each link member, the first-mentioned axle and the extension being provided on the other end region of each link member.

The present invention further provides a keyboard comprising a plurality of key switches, each of the key switches being one as defined above.

BRIEF DESCRIPTION OF THE DRAWINGS

The above and other objects, features and advantages of the present invention will become more apparent from the following description of preferred embodiments in connection with the accompanying drawings, in which.

DESCRIPTION OF THE PREFERRED EMBODIMENT

Figure 1:
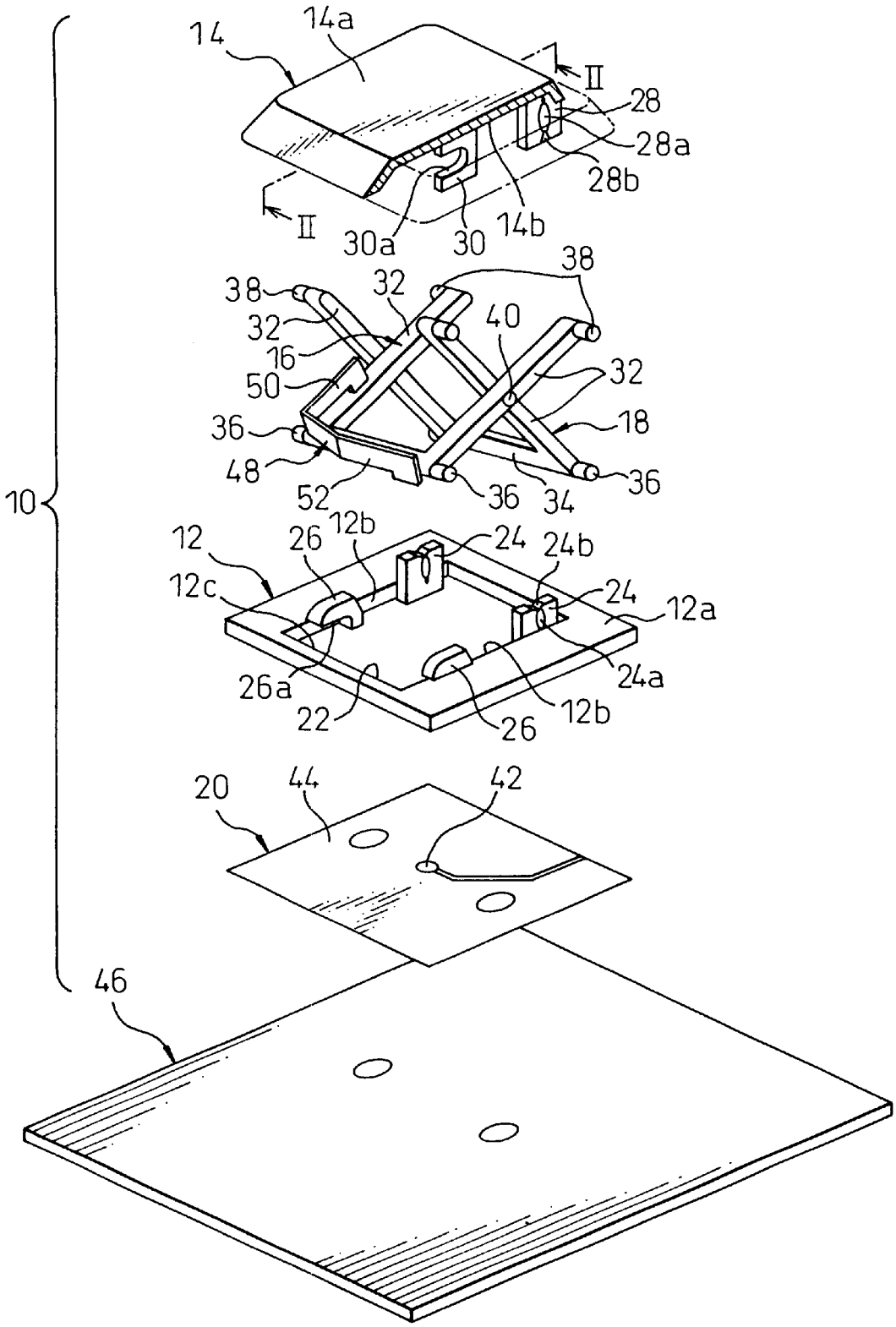
FIG. 1 is an exploded perspective view showing a key switch according to a first embodiment of the present invention.
Figure 2:
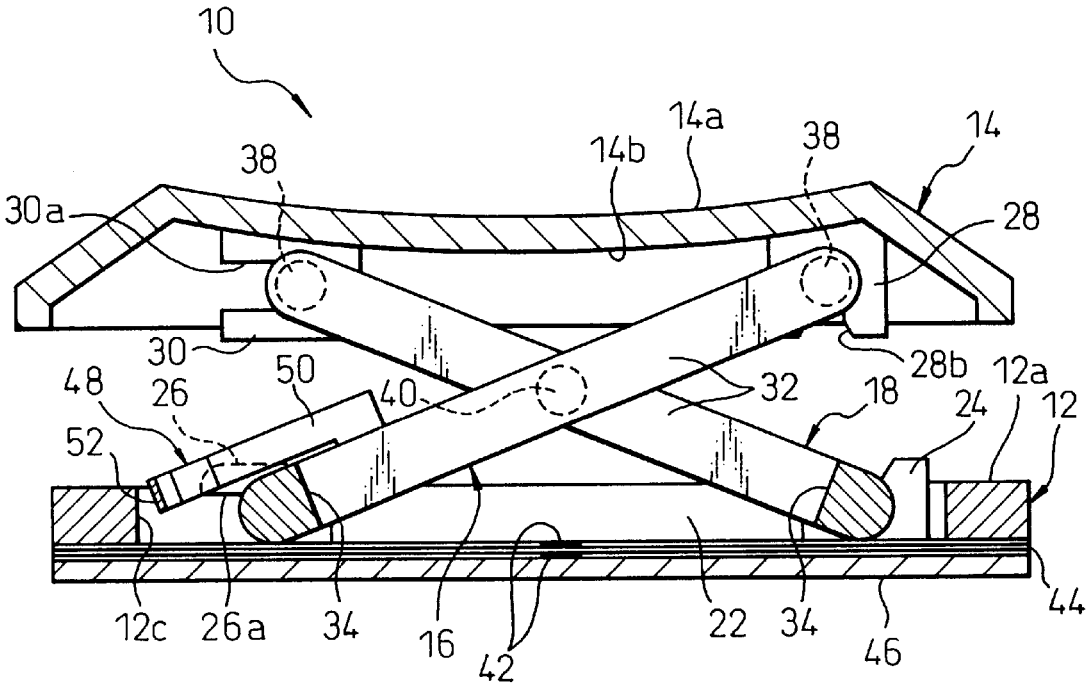
FIG. 2 is a cross-sectional view taken along the line II—II of the key switch of FIG. 1 in an assembled state.

Referring now to the drawings, in which same or similar components are denoted by common reference numerals, FIG. 1 is an exploded perspective view showing a key switch 10 according to a first embodiment of the present invention, and FIG. 2 is a cross-sectional view of the key switch 10 of FIG. 1 in the non-operated condition. The key switch 10 includes a base 12, a key top 14 disposed movably in the vertical or up-and-down direction on a major surface 12*a* of the base 12 and having an operation surface 14*a* adapted to be pressed by an operator's finger, a pair of link members 16, 18 for supporting the key top 14 above the base 12 and directing or guiding the key top 14 in the vertical or the up-and-down direction, and a switching mechanism 20 for opening and closing a pair of contacts of an electric circuit in correspondence with the vertical motion of the key top 14.

The base 12 is a frame-like member having a rectangular center opening 22 covered by the key top 14. The base 12 is provided, along a pair of opposed inner peripheral surfaces 12*b* thereof defining the center opening 22, with a pair of pivot supports 24 and a pair of slide supports 26 spaced from the pivot supports 24 in a longitudinal or forward/backward direction (left-right direction in FIG. 2). The pair of pivot supports 24 are located at a rear end side of the base 12 (at a right end side in FIG. 2) and spaced apart from each other, and the pair of slide supports 26 are located at a front end side of the base 12 (at a left end side in FIG. 2) and spaced apart from each other.

Each of the pivot supports 24 is formed as a small plate, a part of which projects from the major surface 12*a* of the base 12, and includes a bearing hole 24*a* penetrating through the thickness of the plate and a slit 24*b* extending generally perpendicularly to the major surface 12*a* to communicate with the bearing hole 24*a*. The pivot supports 24 are positioned on the inner peripheral surface 12*b* of the base 12 in such a manner that the bearing holes 24*a* of respective pivot supports 24 are aligned with each other in the axial direction thereof. Each of the slide supports 26 includes a wall portion projecting from the major surface 12*a* and the inner peripheral surface 12*b* of the base 12, and extends in the shape of L, and a bearing slot 26*a* extending generally parallel to the major surface 12*a* is formed inside the wall portion. The slide supports 26 are positioned on the inner peripheral surface 12*b* of the base 12 in such a manner that the bearing slot 26*a* of respective slide supports are disposed with each other in the corresponding position. Further, the pivot support 24 and the slide support 26 in a corresponding position are aligned with each other in a longitudinal or forward/backward direction along the inner peripheral surface 12*b* of the base 12.

The key top 14 is a dish-like member having a generally rectangular profile, and includes a pair of pivot supports 28 and a pair of slide supports 30 spaced from the pivot supports 28 in the longitudinal or forward/backward direction (in left/right direction in FIG. 2), both provided on an inner surface 14*b* of the key top 14 opposite to the operation surface 14*a* (only one pivot support 28 and only one slide support 30 are shown). The pair of pivot supports 28 are located at a rear end side of the key top 14 (a right end side in FIG. 2), and spaced apart from each other, and the pair of slide supports 30 are located at a front end side of the key top 14 (a left end side in FIG. 2), and spaced apart from each other.

Each of the pivot supports 28 is formed as a small plate uprightly projecting from the inner surface 14*b* of the key top 14, and includes a bearing hole 28*a* penetrating through the thickness of the plate and a slit 28*b* extending generally perpendicularly to the inner surface 14*b* to communicate with the bearing hole 28*a*. The pivot supports 28 are positioned on the inner surface 14*b* of the key top 14 in such a manner that the bearing hole 28*a* of respective pivot supports 28 are aligned with each other in a axial direction thereof. Each of the slide supports 30 is also formed as a small plate uprightly projecting from the inner surface 14*b* of the key top 14, and includes a bearing slot 30*a* penetrating through the thickness of the plate and extending generally parallel to the inner surface 14*b*. The slide supports 30 are positioned on the inner surface 14*b* of the key top 14 in such a manner that the bearing slots 30*a* of respective slide supports 30 are disposed in a corresponding position with each other. The pivot support 28 and the slide support 30 in a corresponding location are substantially aligned with each other in a longitudinal or forward/backward direction on the inner surface 14*b* of the key top 14.

The pair of link members 16, 18 are structured as a first link member 16 and a second link member 18 which have a mutually substantially identical shape and which are assembled together so as to be provided with an X-shape in side view. Each of the link members 16, 18 integrally includes two arms 32 extending parallel to each other, and a connecting portion 34 mutually connecting the ends of the arms 32. Axles 36 are provided on the first ends of arms 32 to mutually coaxially project on the opposite sides of the connecting portion 34. Axles 38 are provided on the other ends of the arms 32 to mutually coaxially project on the same side as the axles 36. The first link member 16 and second link member 18 are pivotably connected with each other by pivots 40 provided at generally longitudinal centers of the respective pair of arms 32.

The axles 36 formed on the first ends of the arms 32 of the first link member 16 are slidably fitted or received in the respective bearing slots 26*a* of the slide supports 26 on the base 12, and the axles 38 formed on the other ends of the arms 32 of the first link member 16 are pivotably fitted or received in the bearing hole 28*a* of the pivot supports 28 on the key top 14, whereby the first link member 16 is arranged between the base 12 and the key top 14 in such a manner as to be pivotable about the axles 38. The axles 36 formed on the first ends of the arms 32 of the second link member 18 are pivotably fitted or received in the respective bearing holes 24*a* of the pivot supports 24 on the base 12, and the axles 38 formed on the other ends of the arms 32 of the second link member 18 are slidably fitted or received in the respective bearing slots 30*a* of the slide supports 30 on the key top 14, whereby the second link member 18 is arranged between the base 12 and the key top 14 in such a manner as to be pivotable about the axles 36. Therefore, in this embodiment, the axles 36 of the first link member 16 and the axles 38 of the second link member 18 constitute sliding portions of the respective link members 16, 18.

The first and second link members 16, 18 are interlocked to each other through the pivot 40 between the base 12 and the key top 14 in such a manner that they are synchronously pivotable about respective axles 38, 36 in opposite direction, and that axles 36, 38 slide horizontally along the base 12 and the key top 14, whereby the key top 14 is permitted to be subjected to a parallel displacement in a substantially vertical direction in relation to the major surface 12*a* of the base 12, while keeping a predetermined posture of the key top 14 wherein the operation surface 14*a* is substantially parallel to the major surface 12*a* of the base 12.

The initial uppermost position of the key top 14 during a key-entry stroke is defined when the shifting motion of each axle 36 (i.e., the sliding portion) of the first link member 16 toward each axle 36 (i.e., the fixed portion) of the second link member 18 is stopped by a wall portion defining the bearing slot 26*a* of each slide support 26. As the key top 14 moves downward from this uppermost position, each of the axles 36 of the first link member 16 moves in sliding displacement away from the axles 36 of the second link member 18. When the key top 14 reaches to the lowermost position of key-entry stroke, the pair of link members 16, 18 are housed inside the inner surface 14*b* of the key top 14, and are received in the center opening 22 of the base 12.

The switching mechanism 20 of the key switch 10 includes a sheet-like switch 44 (hereinafter referred to as a membrane switch 44) having a pair of sheet substrates each carrying a contact 42, and an actuating member (not shown) which is disposed between the key top 14 and the membrane switch 44 and which operates so as to close the two contacts 42 as the key top 14 moves downward. The two sheet substrates have the well-known construction of flexible printed circuit boards with the contacts 42 provided on the surface of the film substrates. The membrane switch 44 is supported beneath the base 12 on a supporting plate 46, and the two contacts 42 which are opposed to each other are positioned in the center of the opening 22 of the base 12. The actuating member will be described later.

The pair of contacts 42 are normally held open by the inherent stiffness of the sheet substrates via a spacer interposed between the two sheet substrates and positioned beneath the actuating member. If the key top 14 is pushed down by a key-entry operation while being directed by the first and second link members 16, 18, upon reaching a predetermined pushed-down position of the key top 14, the actuating member exerts pressure onto the upper sheet substrate on the outer surface, thereby to close the pair of contacts 42. When the pushing-down force on the key top 14 is released, the key top 14 returns to the initial uppermost position as described later, and the actuating member leaves the membrane switch 44 to open the pair of contacts 42.

The key switch 10 further includes a plate spring 48 or an elastic member, disposed between the base 12 and the first link member 16, which acts as biasing means for elastically urging the key top 14 upwardly away from the base 12. The plate spring 48 includes, in an integral manner, a first spring portion 50 extending along a fixed-end side in a direction substantially parallel to a shifting direction of the axles 36 as the sliding portion of the first link member 16, and a second spring portion 52 extending along a free-end side in a direction intersecting the first spring portion 50. The plate spring 48 further includes a third spring portion 54 integrally formed between the first and second spring portions 50, 52 and extending in a direction intersecting both portions 50, 52 at respective obtuse angles.

The plate spring 48 is fixedly connected, at the proximal end 50*a* of the first spring portion 50 thereof, to a point between the axle 36 of one arm 32 of the first link member 16 and the pivot 40 thereof, and is abutted, at the distal end 52*a* of the second spring portion 52, to the inner peripheral surface 12*c* at the front side of the base 12. The plate spring 48 exerts an elastic restoring force, mainly by the first spring portion 50, the second spring portion 52 and the third spring portion 54, and acts as a compression spring between the inner peripheral surface 12*c* of the base 12 and the arm 32 of the first link member 16.

Each of the first spring portion 50, the second spring portion 52 and the third spring portion 54 of the plate spring 48 is of a flat shape in unloaded condition. The first spring portion 50 extends in parallel to one arm 32 of the first link member 16 in the unloaded condition. The second spring portion 52 extends along the connecting portion 34 of the first link member 16 in the unloaded condition. In this respect, the phrase that the first spring portion 50 of the plate spring 48 "extends in a direction substantially parallel to the sliding or shifting direction of each axle 36, or the sliding portion, of the first link member 16", is an expression which takes the above described pivoting motion of the first link member 16, corresponding to the key-entry operation of the key top 14, into consideration. That is, in practice, the first spring portion 50 pivots together with the arm 32, so that it is disposed in inclined relationship at varying angle to the sliding or shifting direction of each axle 36. However, as described later, when the first spring portion 50 of the plate spring 48 elastically deforms in correspondence with a key-entry operation of the key top 14, it shows a behavior deflecting in the direction substantially perpendicular to the shifting direction of each axle 36 of the first link member 16. Therefore, in this specification, the geometrical shape of the spring portion exhibiting such a behavior is defined as "extends in a direction substantially parallel to the sliding or shifting direction of the sliding portion of the link member".

When no external force is applied to the key top 14, the plate spring 48 urges or biases the connecting portion 34 of the first link member 16 via the arm 32 toward a backward position spaced from the inner peripheral surface 12*c* of the base 12 and supports the connecting portion 34 in this position, as well as, through the first link member 16 and the second link member 18 interlocked thereto, urges or biases the key top 14 toward the initial position vertically upwardly away from the base 12 and supports the key top in this position (see FIG. 2).

When the key top 14 is pushed down by a key-entry operation, the axles 36 of the first link member 16 slidingly move forward along the bearing slot 26*a* of the slide supports 26 of the base 12 and, simultaneously, the connecting portion 34 shifts toward the inner peripheral surface 12*c* of the base 12. During this operation, the plate spring 48 is deformed while exerting a biasing or elastic restoring force to the arm 32 of the first link member 16 in a direction orthogonal to the pushing-down direction of the key top 14. This biasing force acts, upon the axles 36 of the first link member 16 engaged with the slide supports 26 of the base 12, in a horizontal direction along the bearing slot 26*a,* that is, as a biasing force in a direction generally orthogonal to the pushing-down direction of the key top 14. When the pushing-down force to the key top 14 is released, the plate spring 48 elastically restores to return the key top 14 to the initial position through the first and second link members 16, 18.

Figure 3A:
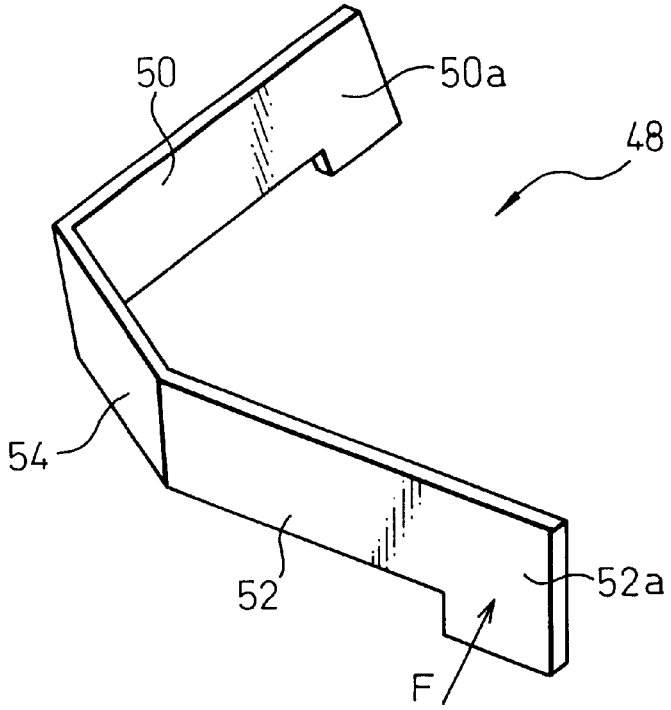
FIGS. 3A and 3B are perspective views of a plate spring used in the key switch of FIG. 1, respectively showing unloaded and loaded conditions.
Figure 3B:
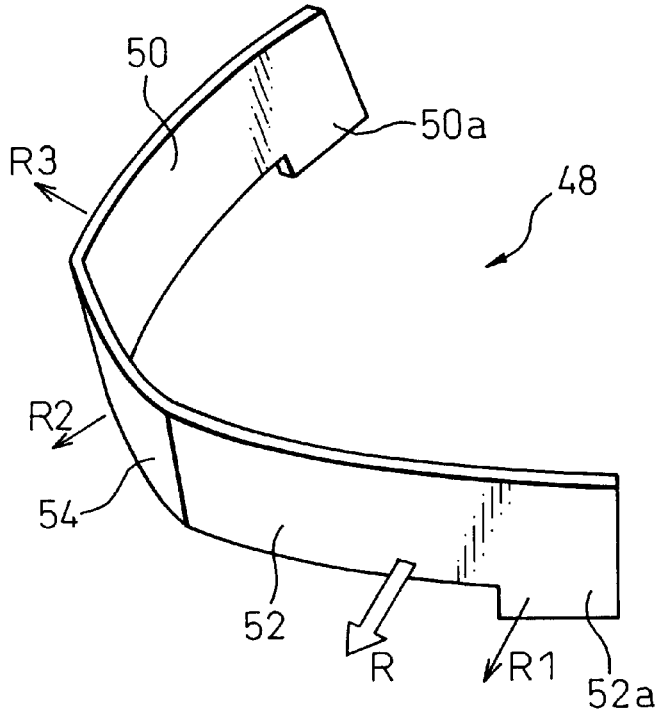

As shown in FIGS. 3A and 3B, when the key top 14 is pushed down, the second spring portion 52 of the plate spring 48 is deflected, by a pushing force F exerted to the distal end 52*a* of the second spring portion 52 from the inner peripheral surface 12*c* of the base 12, in a direction substantially orthogonal to the shifting direction of each axle 36 of the first link member 16, thereby to produce an elastic restoring force R1. During this operation, the third spring portion 54 of the plate spring 48 is deflected due to the deformation of the second spring portion 52, so as to produce an elastic restoring force R2, and the first spring portion 50 is deflected due to the deformation of the third spring portion 54, in a direction substantially orthogonal to the shifting direction of each axle 36 of the first link member 16, so as to produce an elastic restoring force R3. Thus, the plate spring 48 exerts the resultant force R of the elastic restoring forces R1, R2 and R3 produced in different directions by the respective spring portions 50, 52 and 54, as a biasing force to the arm 32 of the first link member 16, and thereby urges or biases the key top 14 toward the initial position.

In the key switch 10 constructed as described above, the plate spring 48 as the key top biasing means is not placed, unlike the dome-shaped elastic actuating member in the conventional key switch, between the key top 14 and the membrane switch 44 in the height direction of the key switch 10, so that the entire height of the key switch 10 can be reduced as much as possible upon both the non-operated and operated condition thereof. Further, the plate spring 48 is integrally formed from the first spring portion 50 extending parallel to one arm 32 of the first link member 16 in an unloaded condition and the second spring portion 52 extending along the connecting portion 34 of the first link member 16 in an unloaded condition, so that the total length of the spring portions 50, 52 and 54 which mainly produce the elastic restoring force can be made greater than the length of the connecting portion 34 of the first link member 16. Therefore, when the dimension of the key switch 10 is to be reduced, the total length of the spring portions 50, 52 and 54 of the plate spring 48 can be maintained sufficiently large, thereby avoiding an unnecessary increase of the elastic biasing force exerted to the key top 14 toward the initial position. At the same time, the bending stress produced in the plate spring 48 during key-entry operation is decreased, so that degradation of durability of the plate spring 48 can be avoided.

Moreover, the plate spring 48 can cooperate with the first link member 16 so as to exert a biasing force onto the key top 14, in a non-linear relationship with the displacement of the key top 14, similar to the dome-shaped elastic actuating member, as described later. In this respect, since the total length of the spring portion 50, 52 and 54 of the plate spring 48 can be maintained sufficiently large irrespective of the dimension of the key switch 10, certain degrees of freedom in design are allowed for the plate spring 48. That is, a selective range of optimal dimension and geometry of the plate spring arises, which enables the desired biasing force to be produced. Thus, it is possible, with the plate spring 48, to achieve a desired biasing force in non-linear relationship with a displacement of the key top 14, and to improve the productivity of the key switch 10 without affecting the key-entry operating properties. In addition, a key-entry operation with a relatively soft touch can be advantageously achieved since the plate spring 48 urges or biases the key top 14 upwardly toward the initial position with the resultant force R of the elastic restoring forces R1, R2 and R3 produced in different directions by the respective spring portions 50, 52 and 54, as the key top 14 moves downward.

In the above first embodiment, the plate spring 48 is fixed to one arm 32 of the first link member 16, at the proximal end 50*a* of the first spring portion 50, so that the shifting amount of the plate spring 48 in the sliding direction of each axle 32 becomes small compared to the shifting amount of each axle 32 of the first link member 16. Therefore, it is necessary to design the plate spring 48 such that the deflections of the respective spring portions 50, 52 and 54 are sufficient to produce a desired biasing force. In this respect, in the case where a plate spring 56, shown as a modification in FIG. 4, which is connected to the front inner peripheral surface 12*c* defining the center opening 22 of the base 12, is used in place of the plate spring 48, the degree of design freedom for the plate spring 56 is further improved.

The plate spring 56 according to the modification is integrally comprised of a first spring portion 58 extending along the fixed-end side substantially in parallel to the shifting direction of the axles 36 of the first link member 16, a second spring portion 60 extending along the free-end side in a crossing relationship with the first spring portion 58, and a third spring portion 62 extending between the first and second spring portions 58, 60 in crossing relationship at respective obtuse angles therewith. The plate spring 56 is fixed at the proximal end of the first spring portion thereof to a local concave portion of the inner peripheral surface 12*c* at the front side of the base 12, and is abutted at a desired point of the second spring portion 60 to the connecting portion 34 of the first link member 16.

The plate spring 56 produces an elastic restoring force mainly by the first spring portion 58, the second spring portion 60 and the third spring portion 62, and acts as a compression spring between the inner peripheral surface 12*c* of the base 12 and the arm 32 of the first link member 16. Each of the first spring portion 58, the second spring portion 60 and the third spring portion 62 of the plate spring 56 has a flat shape in an unloaded condition. The first spring portion 58 extends in parallel to the opposed inner peripheral surface 12*b* of the base 12 in the unloaded condition. The second spring portion 60 extends along the front inner peripheral surface 12*c* of the base 12 in the unloaded condition.

It will be understood from the construction of the modification as described above that the same operative effect can be achieved as in the embodiment of FIG. 1. Particularly, in this modification, since the second spring portion 60 of the plate spring 56 is abutted to the connecting portion 34 disposed coaxially with the axle 36 or the sliding portion of the first link member 16, an adequate amount of deflection of the respective spring portion 58, 60 and 62 can be ensured within the dimensional limit of the base 12, so that the degree of design freedom of the plate spring 56 is further improved.

In the key switch 10 according to the present invention, the plate spring 48, 56 having the three-dimensional geometries as described above is employed to obtain the same non-linear key-entry operating properties as in the conventional key switch employing a dome-shaped elastic actuating member. This is attributed to the biasing force loaded by the plate spring 48, 56 to the first link member 16 in the direction generally orthogonal to the pushed-down direction of the key top 14. In the case where the plate spring 56 is used, for example, when a pushing-down force is applied in the vertically downward direction to the upper end of the first link member 16 through the key top 14, an elastic reaction force of the plate spring 56 is loaded in a horizontal direction to the connecting portion 34 at the lower end of the first link member 16 accordingly. It has been revealed by numerical analysis based on this principle that when the vertical displacement of the upper end of the first link member 16 exceeds a predetermined value, pushing-down force which has gradually increased until that time begins to decrease. Thus, using the key switch 10, a key-entry operating properties such that when the pushed-down distance of the key top 14 exceeds a predetermined value, the biasing force which has gradually increased until that time suddenly decreases, that is, the same key-entry operating properties as in the conventional key switch using a dome-shaped elastic actuating member can be realized. In practice, in the predetermined pushed-down position of the key top 14, a reaction force of the actuating member for opening/closing the membrane switch 20 is added to give the resultant key-entry operating properties.

Figure 6:
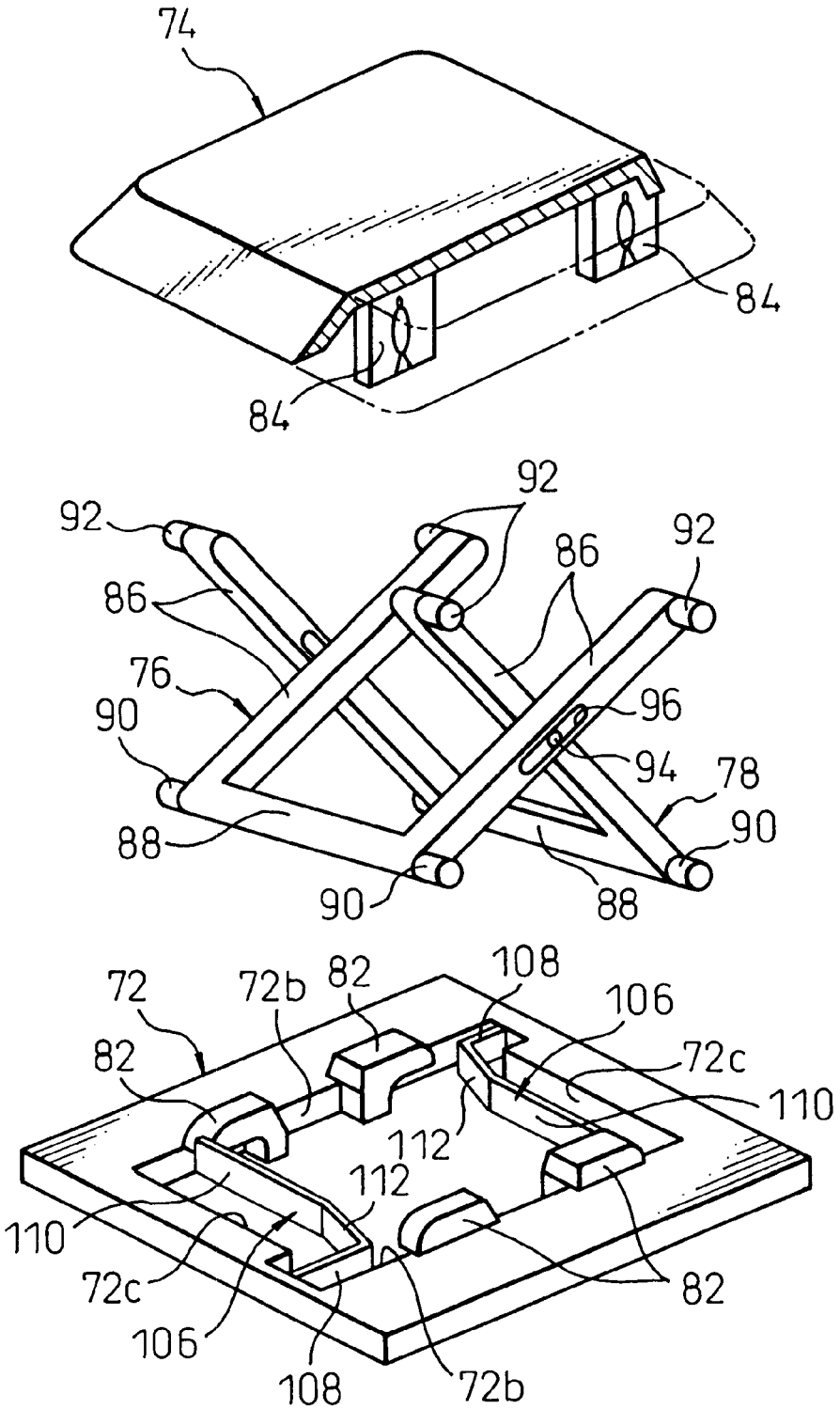
FIG. 6 is an exploded perspective view showing a modification of the key switch of FIG. 5.

FIG. 6 shows a key switch 70 according to a second embodiment of the present invention. The key switch 70 includes a base 72, a key top 74 disposed movably in the vertical or up-and-down direction on a major surface 72*a* of the base 72 and having an operation surface 74*a* adapted to be keyed by an operator's finger, a pair of link members 76, 78 for supporting the key top 74 above the base 72 and directing or guiding the key top 74 in the vertical or the up-and-down direction, and a switching mechanism 20 for opening and closing a pair of contacts of an electric circuit in correspondence with the vertical motion of the key top 74. Since the switching mechanism 20 and a supporting plate 46 supporting the membrane switch 44 thereof have the same construction as in the key switch 10 of the first embodiment, corresponding components are denoted by same reference numerals and detailed descriptions thereof are not repeated.

The base 72 is a frame-like member having a rectangular center opening 80 covered by the key top 74. The base 72 is provided, along a pair of opposed inner peripheral surfaces 72*b* which defines the center opening 80, with two sets of slide supports 82 spaced apart from each other in the longitudinal or forward/backward direction. Each of the slide supports 82 includes wall portion projecting from the major surface 72*a* and inner peripheral surface 72*b* of the base 72, and extends in a L-shape. A bearing slot 82*a* extending generally in parallel to the major surface 72*a* is formed inside this wall portion. The two slide supports 82 that form each set are positioned on the inner peripheral surface 72*b* of the base 72 such that each bearing slot 82*a* is disposed corresponding to the other. In addition, the slide supports 82 on the corresponding side in each set are aligned with each other along the inner peripheral surface 72*b* of the base 72 in longitudinal or forward/backward direction.

The key top 74 is a dish-like member having two sets of pivot supports 84 spaced apart from each other in longitudinal or forward/backward direction, both formed on an inner surface 74*b* of the key top 74 opposite to the operation surface 74*a* (FIG. 6 shows only one pivot support 84 from each set). Each of the pivot supports 84 is formed as a plate uprightly projecting from the inner surface 74*b* of the key top 74, and includes a bearing hole 84*a* penetrating through the thickness of the plate and a slit 84*b* extending generally perpendicularly to the inner surface 74*b* to communicate with the bearing hole 84*a*. The two pivot supports 84 which form each set are positioned on a front end region and a rear end region of the inner surface 74*b* of the key top 74 spaced apart from each other by a distance that permits them to be engaged with a pair of arms of the link members 76, 78, to be described later, such that respective bearing holes 84*a* are aligned with each other in the axial direction. In addition, the pivot supports 84 on corresponding sides in each set are aligned with each other on the inner surface 74*b* of the key top 74 in longitudinal or forward/backward direction.

The pair of link members 76, 78 are structured as a first link member 76 and a second link member 78 which have a mutually substantially identical shape and which are assembled together so as to be provided with a X-shape in a side view. Each of the link members 76, 78 integrally includes two arms 86 extending in parallel to each other, and a connecting portion 88 mutually connecting the ends of the arms 86. Axles 90 are provided on the first ends of arms 86 to mutually coaxially project on the opposite sides of the connecting portion 88. Axles 92 are provided on the other ends of the arms 86 to mutually coaxially project on the same side as the axles 90. The first link member 76 and second link member 78 are pivotably and slidably connected with each other by respective interengagements between pivots 94 projecting from generally longitudinal centers of the first arms 86 of respective link members and elongated holes 96 penetratingly provided at generally longitudinal centers of the other arms 86 of respective link members.

The axles 90 formed on the first ends of the arms 86 of the first link member 76 are slidably fitted or received in the respective bearing slots 82*a* of the slide supports 82 on the front side of the base 72, and the axles 92 formed on the other ends of the arms 86 of the first link member 76 are pivotably fitted or received in the bearing hole 84*a* of the pivot supports 84 on the rear side of the key top 74, whereby the first link member 76 is arranged between the base 72 and the key top 74 in such a manner as to be pivotable about the axles 92. The axles 90 formed on one ends of the arms 86 of the second link member 78 are slidably fitted or received in the respective bearing slots 82*a* of the slide supports 82 on the rear side of the base 72, and the axles 92 formed on the other ends of the arms 86 of the second link member 78 are pivotably fitted or received in the respective bearing holes 84*a* of the pivot supports 84 on the front side of the key top 74, whereby the second link member 78 is arranged between the base 72 and the key top 74 in such a manner as to be pivotable about the axles 92. Therefore, in this embodiment, the axles 90 of the first link member 76 and the axles 92 of the second link member 78 constitute sliding portions of the respective link members 76, 78.

The first and second link members 76, 78 are interlocked to each other between the base 72 and the key top 74 through a slidable connecting portion by the engagement of the pivot 94 with the elongated hole 96 in such a manner that they are synchronously pivotable about respective axles 92 in opposite direction and that respective axles 90 slide horizontally along the base 72, whereby the key top 74 is permitted to be subjected to a parallel displacement in a substantially vertical direction in relation to the major surface 72*a* of the base 72, while keeping a predetermined posture of the key top 74 wherein the operation surface 74*a* is substantially parallel to the major surface 72*a* of the base 72.

The key switch 70 further includes a pair of plate springs 98 or an elastic member, disposed between the base 72 and the first and second link member 76, 78, which acts as biasing means for elastically urging the key top 74 upwardly away from the base 72. Each of the plate springs 98 includes, in an integral manner, a first spring portion 100 extending along a fixed-end side in a direction substantially parallel to the shifting direction of the axles 90 which are sliding portions of the first or second link member 76, 78, a second spring portion 102 extending along the free-end side in a direction intersecting the first spring portion 100, and a third spring portion 104 extending between the first and second spring portions 100, 102 in crossing relationship with both portions 100, 102 at respective obtuse angles.

Each of the plate springs 98 is fixed, at the proximal end of the first spring portion 100, to a point between the axle 90 of one arm 86 of each of the first and second link members 76, 78 and the pivot 94 thereof, and is abutted at the distal end of the second spring portion 102, to each of the front and rear inner peripheral surface 72*c* of the base 72. Each of the plate springs 98 produces an elastic restoring force mainly by the first spring portion 100, the second spring portion 102 and the third spring portion 104, and acts as a compression spring between the inner peripheral surface 72*c* of the base 72 and each of the arms 86 of the first and second link members 76, 78.

Each of the first spring portion 100, the second spring portion 102 and the third spring portion 104 of the plate spring 98 has a flat shape in unloaded condition. The first spring portion 100 extends parallel to one arm 86 of the first or second link member 76, 78 in the unloaded condition. The second spring portion 102 extends along the connecting portion 88 of the first or second link member 76, 78 in the unloaded condition. Thus, each of the plate springs 98 has substantially same construction as the plate spring 48 in the first embodiment as described before.

When no external force is applied to the key top 74, the plate springs 98 urge or bias the connecting portions 88 of the first and second link members 76, 78 via the arms 86 toward a backward and a forward positions spaced from the inner peripheral surface 72*c* of the base 72 and supports the connecting portions 88 in this position, as well as, through the first link member 76 and the second link member 78 interlocked thereto, urge or bias the key top 74 toward the initial position vertically upwardly away from the base 72 and supports the key top 74 in this position.

When the key top 74 is pushed down by a key-entry operation, the axles 90 of the first and second link member 76, 78 slidingly move forward and backward along the bearing slots 82*a* of the slide supports 82 of the base 72, respectively, and simultaneously, the connecting portions 88 shift toward the inner peripheral surface 72*c* of the base 72. During this operation, the two plate springs 98 are deformed while exerting a biasing or elastic restoring force onto the arms 86 of the first and second link member 76, 78 in a direction orthogonal to the pushing-down direction of the key top 74. This biasing force acts, upon the axles 90 of the first and second link members 76, 78 engaged with the slide supports 82 of the base 72, in a horizontal direction along the bearing slot 82*a,* that is, as a biasing force in a direction generally orthogonal to the pushing-down direction of the key top 74.

As already described with reference to the plate spring 48 in the first embodiment, when the key top 74 is pushed down, respective spring portions 100, 102 and 104 of the plate spring 98 produce elastic restoring forces in different directions. Thus, the two plate springs 98 load the resultant force of the elastic restoring forces of spring portions 100, 102 and 104 as biasing forces upon the arms 86 of the first and second link members 76, 78, thereby to urge or bias the key top 74 toward the initial position. When the pushing-down force to the key top 74 is released, the two plate springs 98 elastically restore to return the key top 74 to the initial position through the first and second link members 76, 78.

It will be understood that, in the key switch 70 constructed as described above, the same operative effect can be obtained with the characteristic construction of a pair of plate springs 98 as in the aforementioned key switch 10. As shown in FIG. 6 as a modification, in place of the pair of plate springs 98, a pair of plate springs 106 may be employed which are connected respectively to the front and rear inner peripheral surfaces 72*c* defining the center opening 80 of the base 72.

Each of the plate springs 106 according to the modification is integrally comprised of a first spring portion 108 extending along the fixed-end side substantially in parallel to the shifting direction of the axles 90 of the first or second link member 76, 78, a second spring portion 110 extending along the free-end side in crossing relationship with the first spring portion 108, and a third spring portion 104 extending between the first and second spring portions 108, 110 in crossing relationship with both portions 108, 110 at respective obtuse angles. The two plate springs 106 are fixed at the proximal ends of the respective first spring portions 108 to local concave portion of the front and rear inner peripheral surface 72*c* of the base 72, and are abutted, at a desired point on respective second spring portions 110, to the connecting portions 88 of the first and second link members 76, 78.

Figure 4:
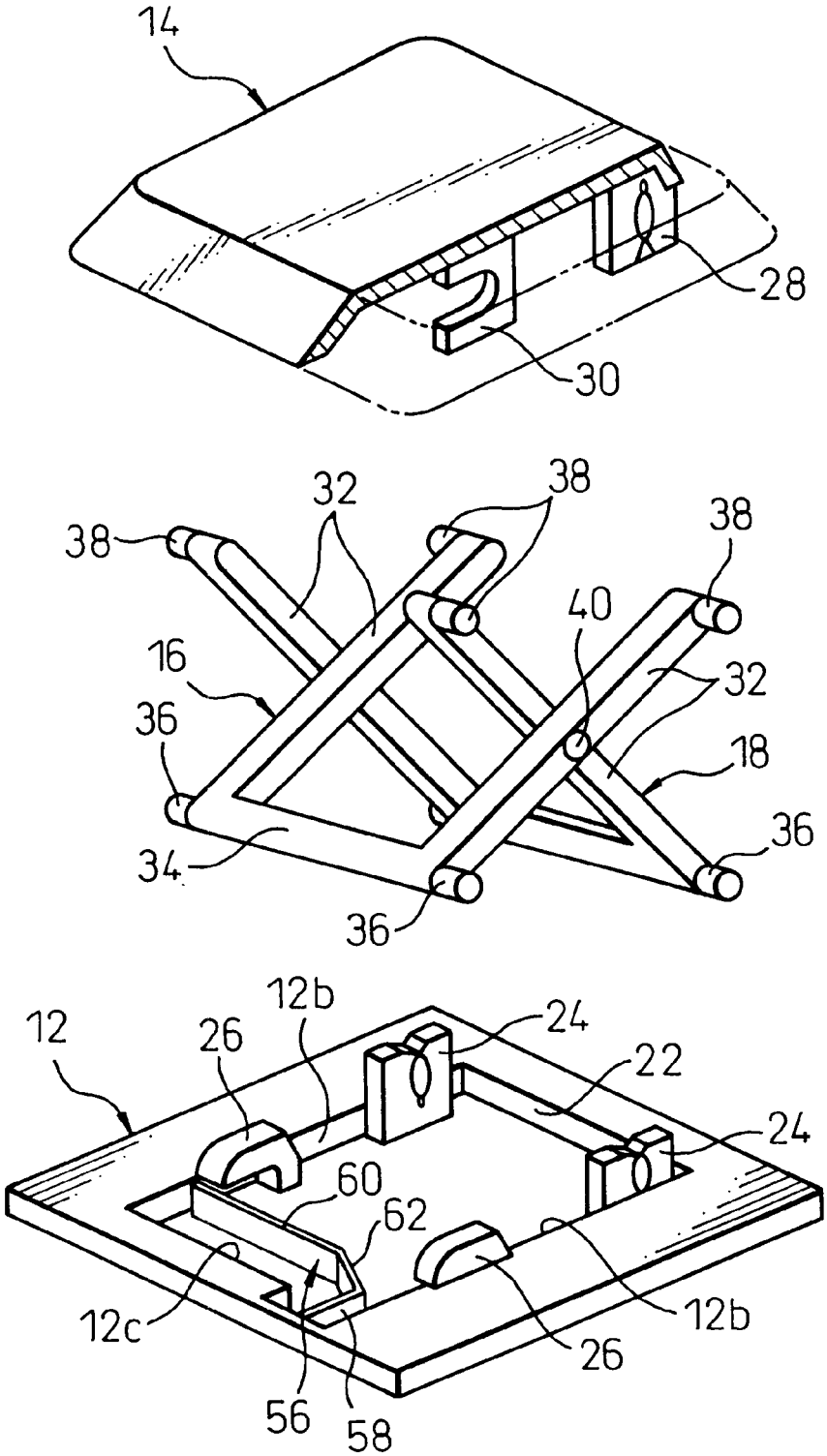
FIG. 4 is an exploded perspective view showing a modification of the key switch of FIG. 1.

Each of the plate springs 106 produces an elastic restoring force mainly through the first spring portion 108, the second spring portion 110 and the third spring portion 112, and acts as a compression spring between each inner peripheral surface 72*c* of the base 72 and the arm 86 of the first or second link member 76, 78. Each of the first spring portion 108, the second spring portion 110 and the third spring portion 112 of the plate spring 106 has a flat shape in unloaded condition. The first spring portion 108 extends parallel to the opposed inner peripheral surface 72*b* of the base 72 in the unloaded condition. The second spring portion 110 extends along each inner peripheral surface 72*c* of the base 72 in the unloaded condition. Thus, each of the plate springs 106 according to the modification has the same construction as the plate spring 56 in the modification as shown in FIG. 4. Therefore, it will be understood from the construction of the modification as described above that the same operative effect can be achieved as in the modification shown in FIG. 4.

Figure 7:
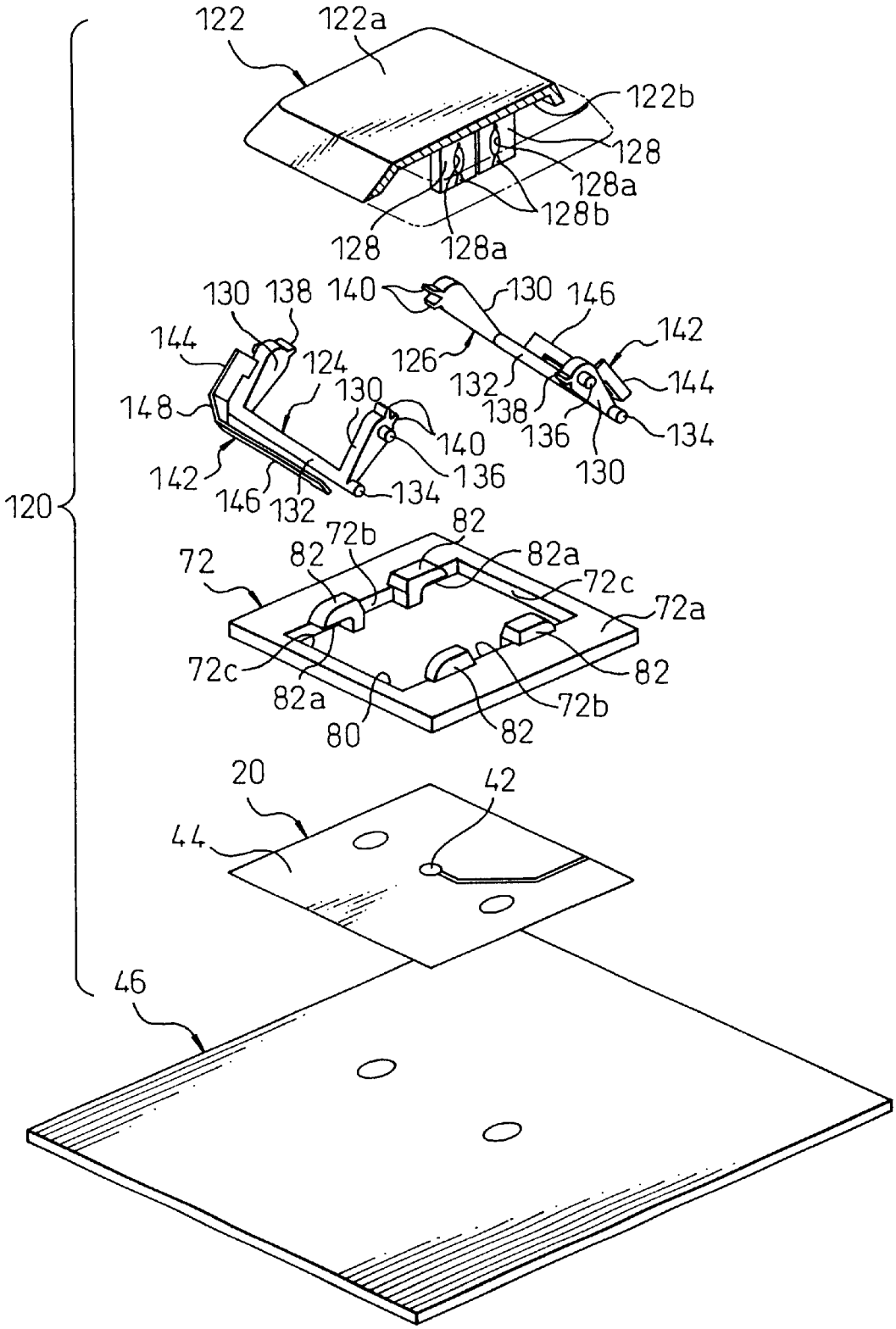
FIG. 7 is an exploded perspective view showing a key switch according to a third embodiment of the present invention.

FIG. 7 shows a key switch 120 according to a third embodiment of the present invention. The key switch 120 includes a base 72, a key top 122 disposed movably in the vertical or up-and-down direction on a major surface 72*a* of the base 72 and having an operation surface 122*a* adapted to be keyed by an operator's finger, a pair of link members 124, 126 for supporting the key top 122 above the base 72 and directing or guiding the key top 122 in the vertical or the up-and-down direction, and a switching mechanism 20 for opening and closing a pair of contacts of an electric circuit in correspondence with the vertical motion of the key top 122. Since the base 72, the switching mechanism 20 and a supporting plate 46 supporting the membrane switch 44 thereof have the same construction as in the key switch 70 of the second embodiment, corresponding components are denoted by same reference numerals and detailed descriptions thereof are not repeated.

The key top 122 is a dish-like member having two sets of pivot supports 128 in parallel to each other in longitudinal or forward/backward direction, both formed on an inner surface 122*b* of the key top 122 opposite to the operation surface 122*a* (FIG. 7 shows only one pivot support 128 from each set). Each of the pivot supports 128 is formed as a plate uprightly projecting from the inner surface 122*b* of the key top 122, and includes a bearing hole 128*a* penetrating through the thickness of the plate and a slit 128*b* extending generally perpendicularly to the inner surface 122*b* to communicate with the bearing hole 128*a*. The two pivot supports 128 which form each set are positioned in generally center region in longitudinal direction of the inner surface 122*b* of the key top 122 spaced apart from each other by a distance that permits them to be engaged with a pair of arms of the link members 124, 126, to be described later, such that respective bearing holes 128*a* are aligned with each other in the axial direction. In addition, the pivot supports 128 on corresponding sides in each set are aligned with each other on the inner surface 122*b* of the key top 122 in a longitudinal or forward/backward direction.

The pair of link members 124, 126 are structured as a first link member 124 and a second link member 126, which have a mutually substantially identical shape, and which are assembled together so as to be provided with a X-shape in a side view. Each of the link members 124, 126 integrally includes two arms 130 extending in parallel to each other, and a connecting portion 132 mutually connecting the ends of the arms 130. Axles 134 are provided on the first ends of arms 130 to mutually coaxially project on the opposite sides of the connecting portion 132. Axles 136 are provided on the other ends of the arms 130 to mutually coaxially project on the same side as the axles 134. The first link member 124 and second link member 126 are rotatably connected with each other by intermeshings between one tooth 138 projecting from the distal end, near the axles 136, of one arms 130 of respective link members and two teeth 140 provided at the distal end, near axles 136, of the other arms 130 of respective link members.

The axles 134 formed on the first ends of the arms 130 of the first link member 124 are slidably fitted or received in the respective bearing slots 82*a* of the slide supports 82 on the front side of the base 72, and the axles 136 formed on the other ends of the arms 130 of the first link member 124 are pivotably fitted or received in the bearing hole 128*a* of the pivot supports 128 on the front side of the key top 122, whereby the first link member 124 is arranged between the base 72 and the key top 122 in such a manner as to be pivotable about the axles 136. The axles 134 formed on the first ends of the arms 130 of the second link member 126 are slidably fitted or received in the respective bearing slots 82*a* of the slide supports 82 on the rear side of the base 72, and the axles 136 formed on the other ends of the arms 130 of the second link member 126 are pivotably fitted or received in the respective bearing holes 128*a* of the pivot supports 128 on the front side of the key top 122, whereby the second link member 126 is arranged between the base 72 and the key top 122 in such a manner as to be pivotable about the axles 136. Therefore, in this embodiment, the axles 134 of the first link member 124 and the axles 136 of the second link member 126 constitute sliding portions of the respective link members 124, 126.

The first and second link members 124, 126 are interlocked to each other between the base 72 and the key top 122 through intermeshings between one tooth 138 and two teeth 140, so as to be synchronously pivotable in opposite direction about respective axles 136, with respective axles 134 sliding horizontally along the base 72 in opposite direction to each other, whereby the key top 122 is permitted to be subjected to a parallel displacement in a substantially vertical direction in relation to the major surface 72*a* of the base 72, while keeping a predetermined posture of the key top 122 wherein the operation surface 122*a* thereof is substantially parallel to the major surface 72*a* of the base 72.

The key switch 120 further includes a pair of plate springs 142 or an elastic member, disposed between the base 72 and the first link member 124 and the second link member 126, which acts as biasing means for elastically urging the key top 122 upwardly away from the base 72. Each of the plate springs 142 includes, in an integral manner, a first spring portion 144 extending along a fixed-end side in a direction substantially parallel to the shifting direction of the axles 134 which are sliding portions of the first or second link member 124, 126, a second spring portion 146 extending along the free-end side in a direction intersecting the first spring portion 144, and a third spring portion 148 extending between the first and second spring portions 144, 146 in a direction intersecting both portions 144, 146 at respective obtuse angles.

Each of the plate springs 142 is fixed, at the proximal end of the first spring portion 144, to a point between the axle 134 of one arm 130 of each of the first and second link members 124, 126 and the pivot 136 thereof, and is abutted at the distal end of the second spring portion 146, to each of the front and rear inner peripheral surface 72*c* of the base 72. Each of the plate springs 142 produces an elastic restoring force mainly by the first spring portion 144, the second spring portion 146 and the third spring portion 148, and acts as a compression spring between the inner peripheral surface 72*c* of the base 72 and the arm 130 of each of the first and second link members 124, 126.

Each of the first spring portion 144, the second spring portion 146 and the third spring portion 148 of the plate spring 142 has a flat shape in an unloaded condition. The first spring portion 144 extends parallel to one arm 130 of the first or second link member 124, 126 in the unloaded condition. The second spring portion 146 extends along the connecting portion 132 of the first or second link member 124, 126 in the unloaded condition. Thus, each of the plate springs 142 has substantially the same construction as the plate springs 48, 98 in the first and second embodiments, as described before.

When no external force is applied to the key top 122, the plate springs 142 urge or bias the connecting portions 132 of the first and second link members 124, 126 via the arms 130 toward a backward and a forward positions spaced from the inner peripheral surface 72*c* of the base 72 and supports the connecting portions 132 in this position, as well as, through the first link member 124 and the second link member 126 interlocked thereto, urge or bias the key top 122 toward the initial position vertically upwardly away from the base 72 and supports the key top 122 in this position.

When the key top 122 is pushed down by a key-entry operation, the axles 134 of the first and second link member 124, 126 slidingly move forward and backward along the bearing slots 82*a* of the slide supports 82 of the base 72, respectively, and, simultaneously, the connecting portions 88 shift toward the inner peripheral surface 72*c* of the base 72. During this operation, the two plate springs 142 are deformed while exerting a biasing or an elastic restoring force onto the arms 130 of the first and second link member 124, 126 in a direction orthogonal to the pushing-down direction of the key top 122. This biasing force acts, upon the axles 134 of the first and second link members 124, 126 engaged with the slide supports 82 of the base 72, in a horizontal direction along the bearing slot 82*a*, that is, as a biasing force in a direction generally orthogonal to the pushing-down direction of the key top 122.

As described with reference to the plate spring 48 in the first embodiment, when the key top 122 is pushed down, respective spring portions 144, 146 and 148 of the plate spring 142 produce elastic restoring forces in different directions from each other. Thus, the two plate springs 142 load the resultant force of the elastic restoring forces of spring portions 144, 146 and 148 as biasing forces upon the arms 130 of the first and second link members 124, 126, and thereby urge or bias the key top 122 toward the initial position. When the pushing-down force on the key top 122 is released, the two plate springs 142 elastically restore to return the key top 122 to the initial position through the first and second link members 124, 126.

Figure 8:
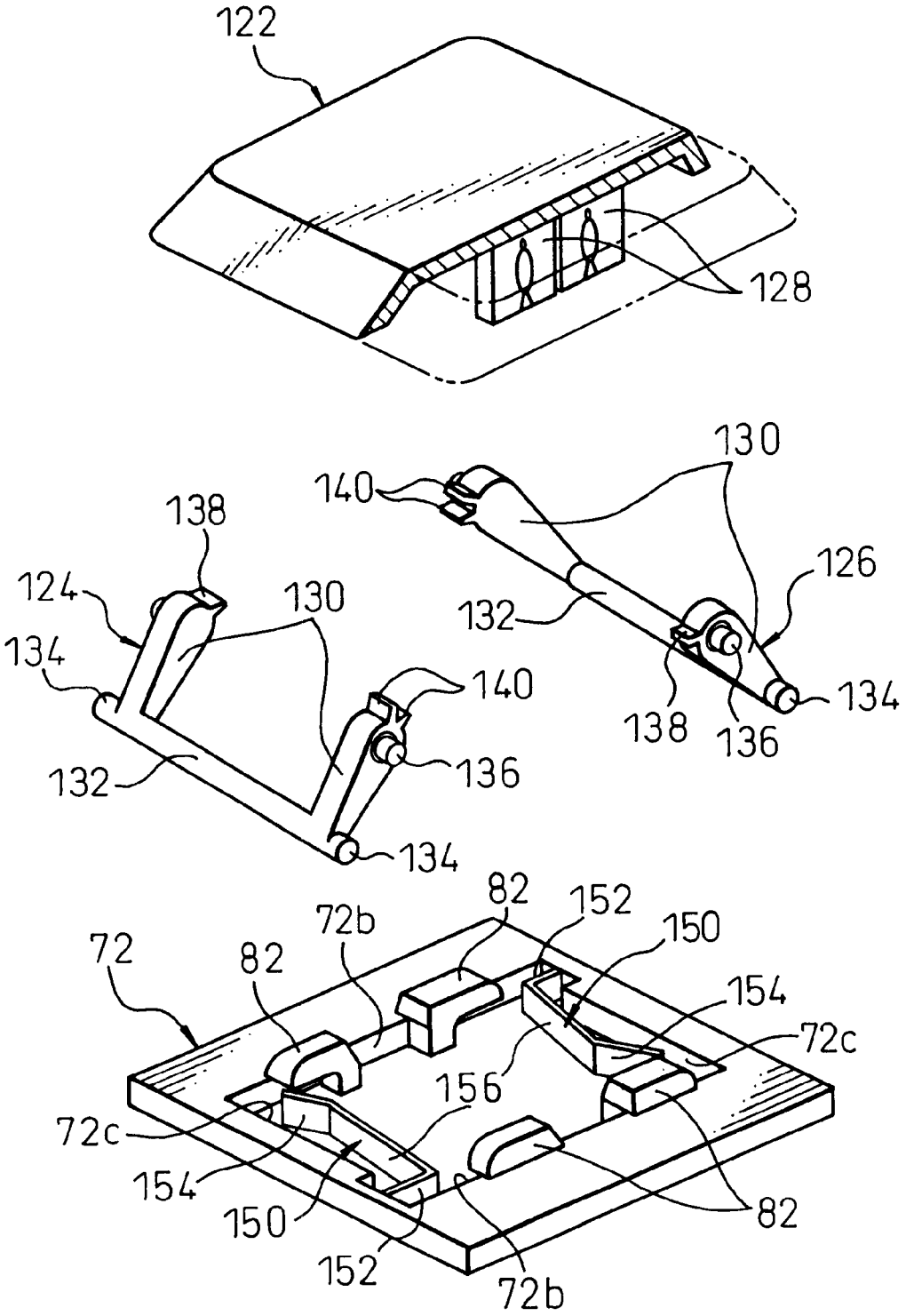
FIG. 8 is an exploded perspective view showing a modification of the key switch of FIG. 7.

It will be understood that, in the key switch 120 constructed as described above, the same operative effect can be obtained with the characteristic construction of a pair of plate springs 142 as in the aforementioned key switch 10. As shown in FIG. 8 as a modification, in place of the pair of plate spring 142, a pair of plate springs 150 may be employed which are connected respectively to the front and rear inner peripheral surfaces 72*c* defining the center opening 80 of the base 72.

Each of the plate springs 150 according to the modification is integrally comprised of a first spring portion 152 extending along the fixed-end side substantially in parallel to the shifting direction of the axles 134 of the first or second link member 124, 126, a second spring portion 154 extending along the free-end side in crossing relationship with the first spring portion 152, and a third spring portion 156 extending between the first and second spring portions 152, 154 in crossing relationship with both portions 152, 154 at respective obtuse angles. The two plate springs 150 are fixed at the proximal ends of the respective first spring portions 152 to local concave portions of the front and rear inner peripheral surfaces 72*c* of the base 72, and are abutted at desired points of respective second spring portions 154 to the connecting portions 132 of the first and second link members 124, 126.

Each of the plate springs 150 produces an elastic restoring force mainly through the first spring portion 152, the second spring portion 154 and the third spring portion 156, and acts as a compression spring between each inner peripheral surface 72*c* of the base 72 and the connecting portion 132 of the first or second link member 124, 126. Each of the first spring portion 152, the second spring portion 154 and the third spring portion 156 of the plate spring 150 has a flat shape in an unloaded condition. The first spring portion 152 extends parallel to the opposed inner peripheral surface 72*b* of the base 72 in the unloaded condition. The second spring portion 154 extends along each inner peripheral surface 72*c* of the base 72 in the unloaded condition. Thus, each plate spring 150 according to the modification has the same construction as the plate spring 56 in the modification as shown in FIG. 4. Therefore, it will be understood from the construction of the modification as described above that the same operative effect can be achieved as in the modification shown in FIG. 4.

The key switches 10, 70, 120 according to the above described embodiments are constructed such that the plate springs 48, 56, 98, 106, 142, 150 or elastic members which urge the key tops 14, 74, 122 upwardly away from the base 12, 72 produce an elastic restoring force corresponding to the motion of the connecting portions 34, 88, 132 that exhibit substantially the same shifting behavior as the sliding portion (axles 36, 90, 134) of the link members 16, 76, 78, 124, 126 when the key tops 14, 74, 122 move vertically. In contrast, in each of the embodiments described below, the plate spring or elastic member, which urges the key top upwardly away from the base, produces the elastic restoring force corresponding to the motion of the loading portion that exhibits different shifting behavior from the sliding portion of the link member when the key top moves vertically.

Figure 9:
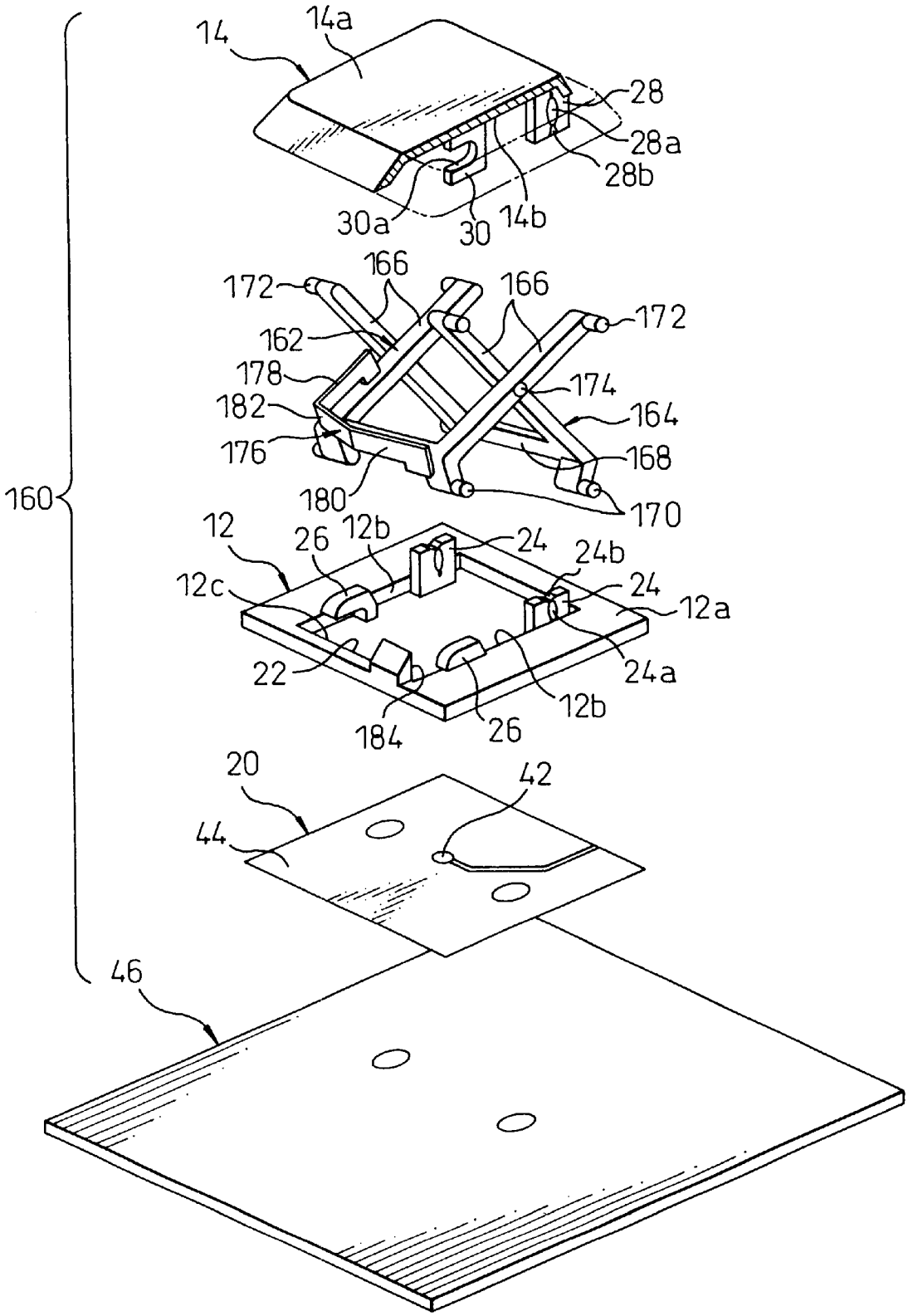
FIG. 9 is an exploded perspective view showing a key switch according to a fourth embodiment of the present invention.

FIG. 9 shows a key switch 160 according to a fourth embodiment of the present invention having this construction. The key switch 160 has, except for the location of the connecting portion in each link member, substantially same construction as the key switch 10 according to the first embodiment. Therefore, same components are denoted by common reference numerals, and a detailed description is not repeated. Thus, the key switch 160 includes a base 12, a key top 14 disposed movably in the vertical or up-and-down direction on a major surface 12*a* of the base 12, a pair of link members 162, 164 for supporting the key top 14 above the base 12 and directing or guiding the key top 14 in the vertical or the up-and-down direction, and a switching mechanism 20 for opening and closing a pair of contacts of an electric circuit corresponding to the vertical motion of the key top 14.

The pair of link members 162, 164 are structured as a first link member 162 and a second link member 164, which have a mutually substantially identical shape, and which are assembled together so as to be provided with a X-shape in a side view. Each of the link members 162, 164 integrally includes two arms 166 extending in parallel to each other, and a connecting portion 168 mutually connecting the arms 166 at bent portions near one ends. Axles 170 are provided on the first ends of arms 166 to mutually coaxially project on the opposite sides of the connecting portion 168. Axles 172 are provided on the other ends of the arms 166 to mutually coaxially project on the same side as the axles 170. The first link member 162 and the second link member 164 are pivotably connected with each other by pivots 174 at generally longitudinal centers of the pairs of arms 166 of respective link members.

The axles 170 formed on the first ends of the arms 166 of the first link member 162 are slidably fitted or received in the respective bearing slots 26*a* of the slide supports 26 on the base 12, and the axles 172 formed on the other ends of the arms 166 of the first link member 162 are pivotably fitted or received in the bearing hole 28*a* of the pivot supports 28 of the key top 14, whereby the first link member 162 is arranged between the base 12 and the key top 14 in such a manner as to be pivotable about the axles 172. The axles 170 formed on the first ends of the arms 166 of the second link member 164 are pivotably fitted or received in the respective bearing holes 24*a* of the pivot supports 24 on base 12, and the axles 172 formed on the other ends of the arms 166 of the second link member 164 are slidably fitted or received in the respective bearing slots 30*a* of the slide supports 30 on the key top 14, whereby the second link member 164 is arranged between the base 12 and the key top 14 in such a manner as to be pivotable about the axles 170.

Construction of the first and second link members 162, 164 is substantially the same as the first and second link members 16, 18 in the key switch 10 of the first embodiment except that the connecting portion 168 is positioned an arbitrary angle about the pivot 174 deviated from the axles 170. Thus, in this embodiment, the axles 170 of the first link member 162 and the axles 172 of the second link member 164 constitute the sliding portion of the link members 162, 164. The first and second link members 162, 164 are interlocked to each other through the pivot 174, so as to be synchronously pivotable, so that the key top 14 is permitted to be subjected to a parallel displacement in a substantially vertical direction in relation to the major surface 12*a* of the base 12, while keeping a predetermined posture of the key top wherein the operation surface 14*a* is substantially parallel to the major surface 12*a*.

The key switch 160 further includes a plate spring 176 or an elastic member, disposed between the base 12 and the first link member 162, which acts as biasing means for elastically urging the key top 14 upwardly away from the base 12. The plate spring 176 includes, in an integral manner, a first spring portion 178 extending along a fixed-end side in a direction substantially parallel to the shifting direction of the axles 170 as the sliding portion of the first link member 162, a second spring portion 180 extending along a free-end side in a direction intersecting the first spring portion 178, and a third spring portion 182 extending between the first and second spring portions 178, 180 in a direction intersecting both portions 178, 180 at respective obtuse angles.

The plate spring 176 is fixedly connected, at the proximal end of the first spring portion 178 thereof, to a point between the axle 170 of one arm 166 of the first link member 162 and the pivot 174 thereof, and is abutted at the distal end of the second spring portion 180, to a supporting wall surface 184 extending upwardly from the front inner peripheral surface 12*c* of the base 12. The plate spring 176 produces an elastic restoring force mainly by the first spring portion 178, the second spring portion 180 and the third spring portion 182, and acts as a compression spring between the inner peripheral surface 12*c* of the base 12 and the arm 166 of the first link member 162.

Each of the first spring portion 178, the second spring portion 180 and the third spring portion 182 of the plate spring 176 has a flat shape in an unloaded condition. The first spring portion 178 extends parallel to one arm 166 of the first link member 162 in the unloaded condition. The second spring portion 180 extends along the connecting portion 168 of the first link member 162 in the unloaded condition. Thus, the plate spring 176 has substantially the same construction as the plate spring 48 in the first embodiment as described before.

When no external force is applied to the key top 14, the plate spring 176 urges or biases the connecting portion 168 of the first link member 162 via the arm 166 thereof toward a backward position spaced from the inner peripheral surface 12*c* of the base 12 and supports the connecting portion 168 in this position, as well as, through the first link member 162 and the second link member 164 interlocked thereto, urges or biases the key top 14 toward the initial position vertically upwardly away from the base 12 and supports the key top 14 in this position.

When the key top 14 is pushed down by a key-entry operation, the axles 170 of the first link member 162 slidingly move forward along the bearing slot 26*a* of the slide supports 26 of the base 12 and, simultaneously, the connecting portion 168 shifts toward supporting surface 184 extending upwardly from the inner peripheral surface 12*c* of the base 12. During this operation, the connecting portion 168 exhibits a shifting behavior different from that of the axles 170 since it is deviated by an arbitrary angle about the pivot 174 from the axles 170. The plate spring 176 is deformed while exerting a biasing or elastic restoring force to the arm 166 of the first link member 162 in a direction orthogonal to the pushing-down direction of the key top 14. This biasing force acts, upon the axles 170 of the first link member 162 engaged with the slide supports 26 of the base 12, in a horizontal direction along the bearing slot 26*a,* that is, as a biasing force in a direction generally orthogonal to the pushing-down direction of the key top 14.

As already described with reference to the plate spring 48 in the first embodiment, when the key top 14 is pushed down, respective spring portions 178, 180 and 182 of the plate spring 176 produce elastic restoring forces in different directions from each other. Thus, the plate spring 176 loads the resultant force of the elastic restoring forces of spring portions 178, 180 and 182 as biasing forces upon the arms 166 of the first link member 162, and thereby urges or biases the key top 14 toward the initial position. When the pushing-down force to the key top 14 is released, the plate spring 176 elastically restores to return the key top 14 to the initial position through the first and second link members 162, 164.

Figure 10:
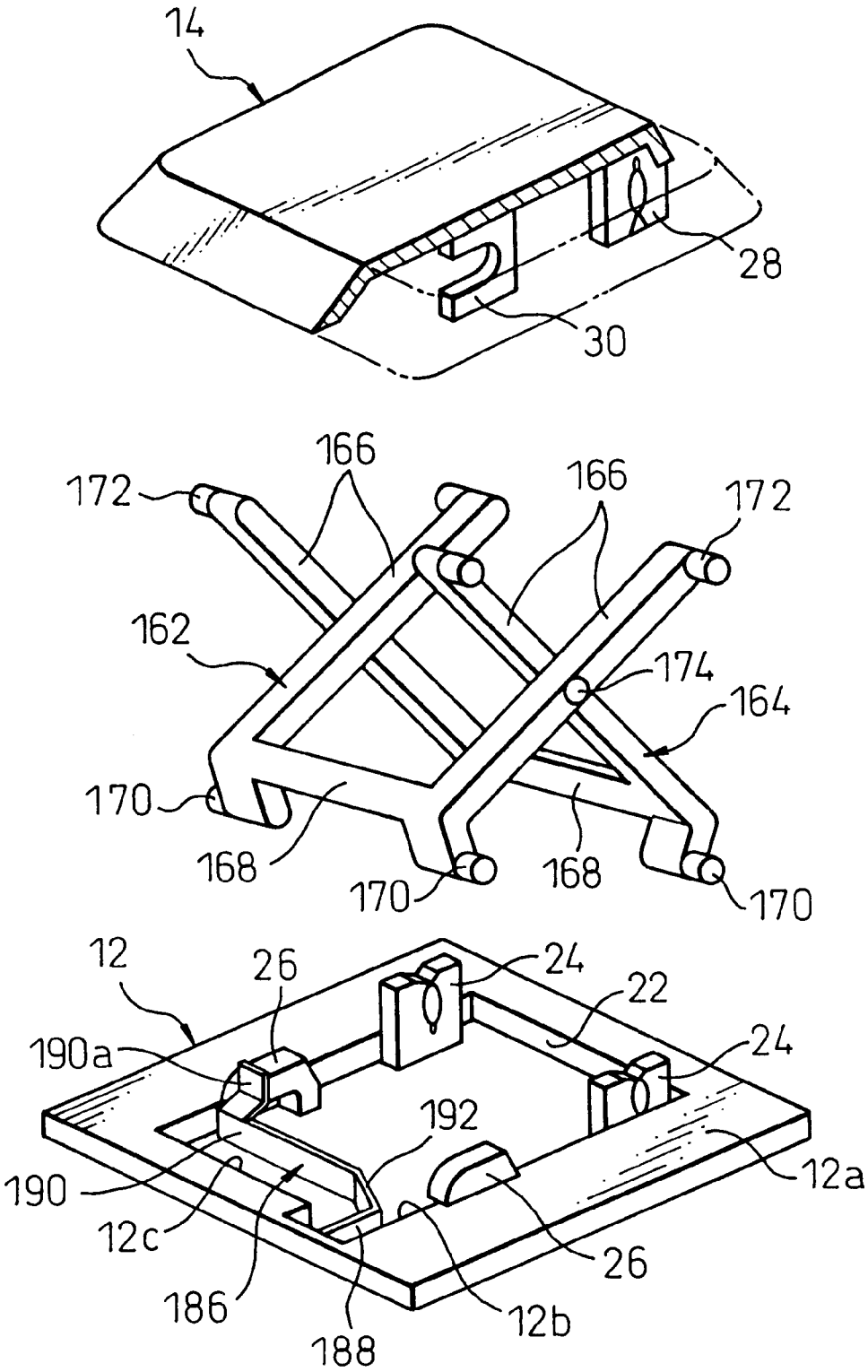
FIG. 10 is an exploded perspective view showing a modification of the key switch of FIG. 9.

It will be understood that, in the key switch 160 constructed as described above, the same operative effect can be obtained with the characteristic construction of the plate spring 176 as in the aforementioned key switch 10. As shown in FIG. 10 as a modification, in place of the plate spring 176, a plate spring 186 may be employed which is connected to the front-side of the inner peripheral surfaces 12*c* defining the center opening 22 of the base 12.

The plate spring 186 according to the modification is integrally comprised of a first spring portion 188 extending along the fixed-end side substantially in parallel to the shifting direction of the axles 170 of the first link member 162, a second spring portion 190 extending along the free-end side in crossing relationship with the first spring portion 188, and a third spring portion 192 extending between the first and second spring portions 188, 190 in a crossing relationship with both portions 188, 190 at respective obtuse angles. The plate spring 186 is fixed at the proximal end of the first spring portion 188 to the local concave portion of the front inner peripheral surface 12*c* of the base 12, and is abutted at an upwardly extending portion 190*a* above the major surface 12*a* of the base 12 at the proximal end of the second spring portion 190 to the connecting portion 168 of the first link member 162.

The plate spring 186 produces an elastic restoring force mainly through the first spring portion 188, the second spring portion 190 and the third spring portion 192, and acts as a compression spring between the inner peripheral surface 12*c* of the base 12 and the connecting portion 168 of the first link member 162. Each of the first spring portion 188, the second spring portion 190 and the third spring portion 192 of the plate spring 186 has a flat shape in an unloaded condition. The first spring portion 188 extends parallel to the opposed inner peripheral surface 12*b* of the base 12 in the unloaded condition. The second spring portion 190 extends along front side inner peripheral surface 12*c* of the base 12 in the unloaded condition. Thus, the plate spring 186 according to the modification has substantially the same construction as the plate spring 56 in the modification as shown in FIG. 4. Therefore, it will be understood from the construction of the modification as described above that the same operative effect can be achieved as in the modification shown in FIG. 4.

It is possible, by using the key switch 160 with the plate spring 176, 186 having the above described three-dimensional configuration, to obtain the same non-linear key-entry operating properties as with a dome-shaped elastic actuating member in a conventional key switch. This is attributed to the biasing force exerted to the first link member 162 by the plate spring 176, 186 in a direction generally orthogonal to the pushed-down direction of the key top 12. Thus, the principle of the operation is basically the same as in the first, second and third embodiments. In the key switch 160, however, the connecting portion 168 of the first link 162 is situated in a position with angular deviation from the axles 170 (or a sliding portion) so that the axles 172 at the upper end of the first link member 162 can be brought lower than the connecting portion 168 of the first link member 162. As a result, in the key switch 160, the pushing-down force exerted to the axles 172 at the upper end of the first link member 162 reaches the maximum at a smaller amount of vertical movement of the axles 172 compared to the pushing force in the first, second and third embodiments. This means that the pushed-down position of the key top 14 where the actuating member comes in contact with the membrane switch (that is, when the operation starts) can be selected over wider range within the up-and-down stroke of the key top 14. Consequently, optimization of the non-linear key-entry operating properties can be achieved more easily.

Figure 11:
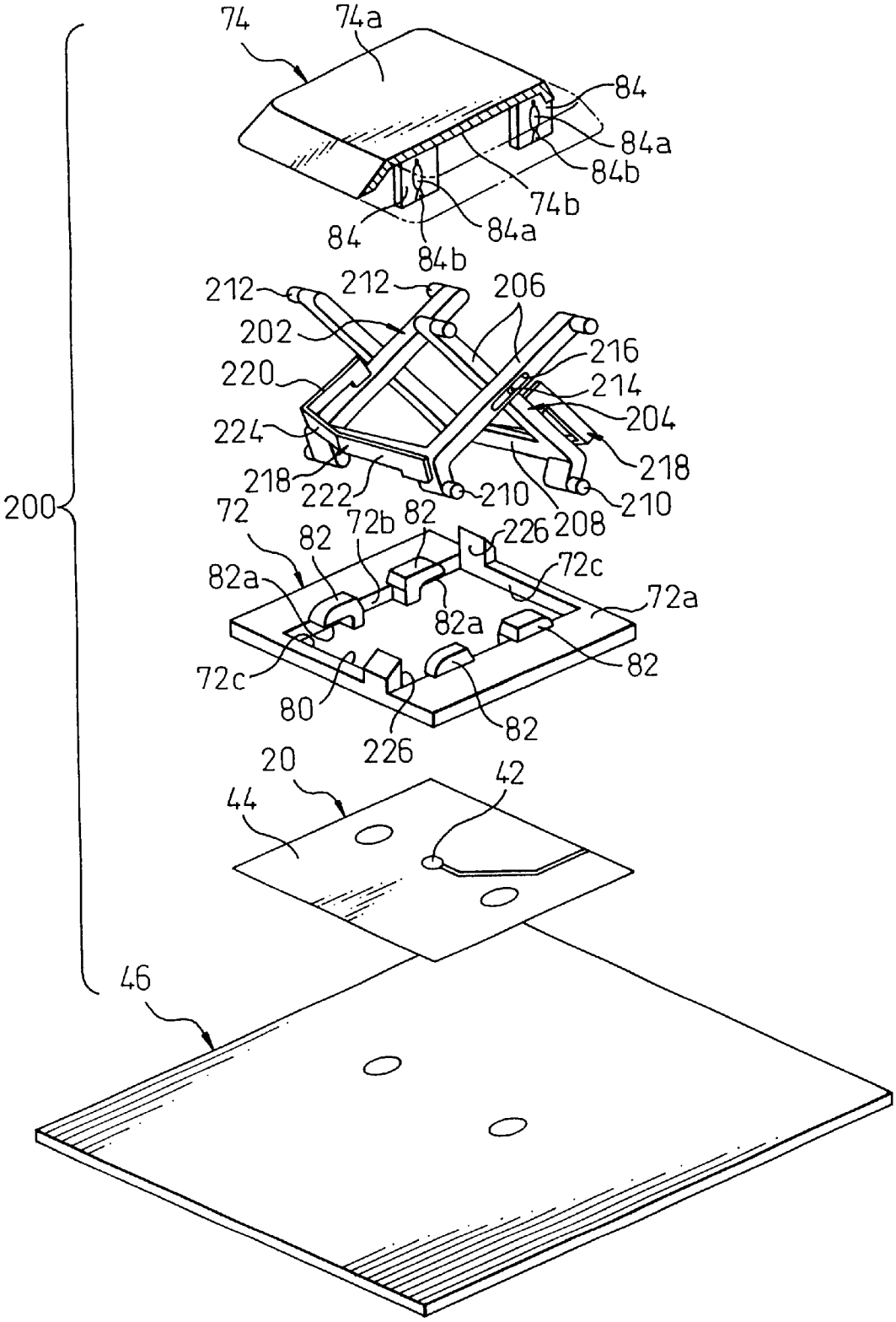
FIG. 11 is an exploded perspective view showing a key switch according to a fifth embodiment of the present invention.
Figure 12:
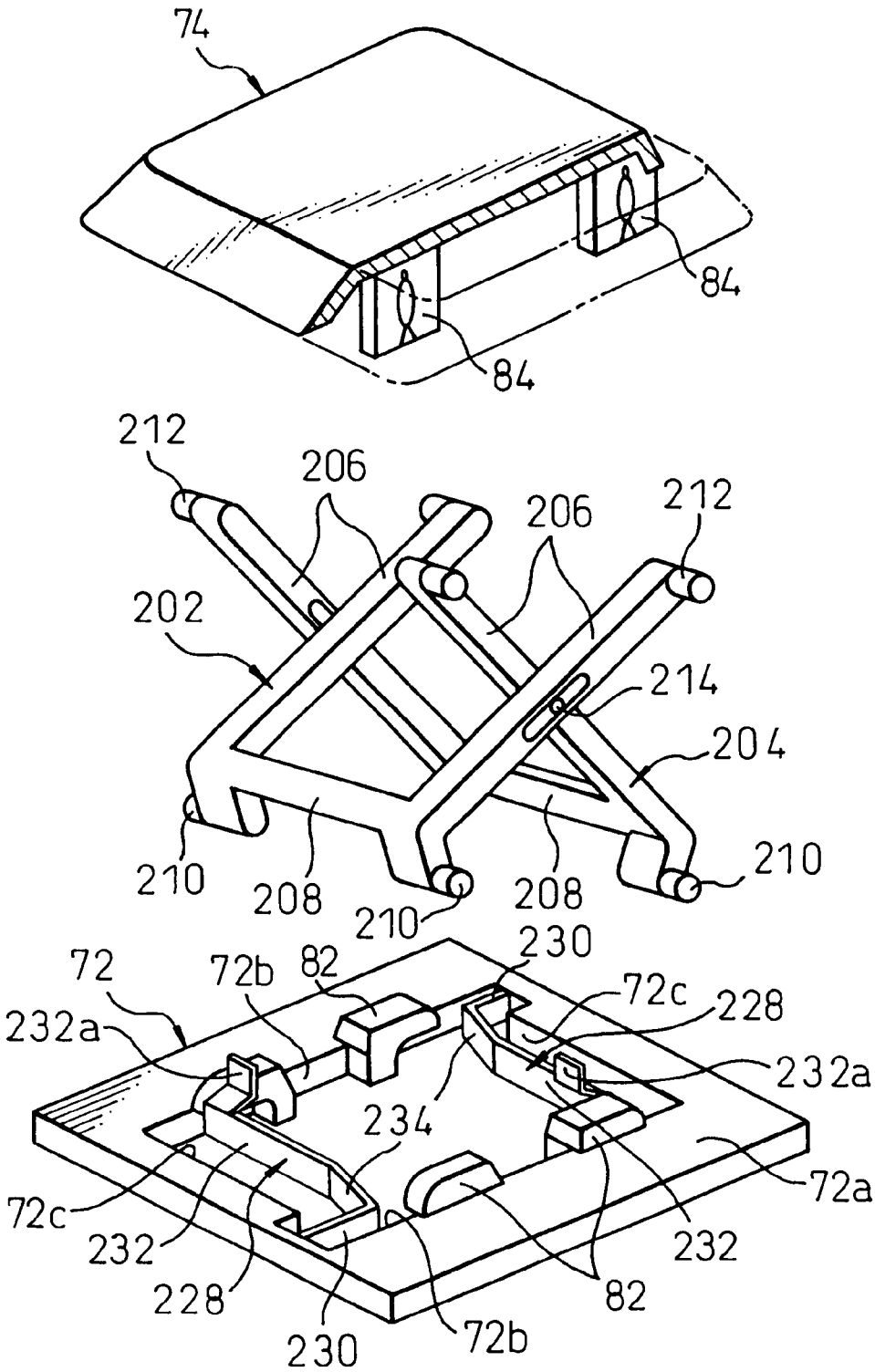
FIG. 12 is an exploded perspective view showing a modification of the key switch of FIG. 11.

FIGS. 11 and 12 show a key switch 200 according to a fifth embodiment of the present invention and its modification, respectively. The key switch 200 has substantially the same construction as the key switch 70 according to the second embodiment except for the difference of the position of the connecting portions in the link members. So, same components are denoted by common reference numerals, and a detailed description thereof is not repeated. Thus, the key switch 200 includes a base 72, a key top 74 disposed movably in the vertical or up-and-down direction on a major surface 72*a* of the base 72, a pair of link members 202, 204 for supporting the key top 74 above the base 72 and directing or guiding the key top 74 in the vertical or the up-and-down direction, and a switching mechanism 20 for opening and closing a pair of contacts of an electric circuit in correspondence with the vertical motion of the key top 74.

The pair of link members 202, 204 are structured as a first link member 202 and a second link member 204, which have a mutually substantially identical shape, and which are assembled together so as to be provided with a X-shape in a side view. Each of the link members 202, 204 integrally includes two arms 206 extending in parallel to each other, and a connecting portion 208 mutually connecting the arms 206 at bent portions near one ends. Axles 210 are provided on the first ends of arms 206 to mutually coaxially project on the opposite sides of the connecting portion 208. Axles 212 are provided on the other ends of the arms 206 to mutually coaxially project on the same side as the axles 210. The first link member 202 and the second link member 204 are pivotably and slidably connected with each other by respective interengagements between pivots 214 projecting from generally longitudinal centers of the first arms 206 of respective link members and elongated holes 216 penetratingly provided at generally longitudinal centers of the other arms 206 of respective link members.

Such a construction of the first and second link members 202, 204 is substantially the same as that of the first and second link members 76, 78 in the key switch 70 according to the second embodiment except that the position of the connecting portion 208 deviates from the axles 210 by an arbitrary angle about the pivot 214. Thus, in this embodiment, the axles 210 of the first link member 202 and the axles 210 of the second link member 204 constitute the sliding portions of the link members 202, 204. The first and second link members 202, 204 are interlocked to each other through the slidable connecting portion 208 by the engagement between the pivot 214 and the elongated holes 216 so as to be synchronously pivotable, so that the key top 74 is permitted to be subjected to a parallel displacement in substantially vertical direction in relation to the major surface 72*a* of the base 72 while keeping a predetermined posture of the key top 74 wherein the operation surface 74*a* is disposed generally parallel to the major surface 72*a* of the base 72.

The key switch 200 further includes a pair of plate springs 218 or elastic members, disposed between the base 72 and the first and second link members 202, 204, as biasing means which elastically urge or bias the key top 74 upwardly away from the base 72. Each of the plate springs 218 includes, in an integral manner, a first spring portion 220 extending along a fixed-end side in a direction substantially parallel to the shifting direction of the axles 210 as the sliding portions of the first and second link members 202, 204, a second spring portion 222 extending along a free-end side in a direction intersecting the first spring portion 220, and a third spring portion 224 extending between the first and second spring portions 220, 222 in a direction intersecting both portions 220, 222 at respective obtuse angles.

Each of the plate spring 218 is fixed, at the proximal end of the first spring portion 220 thereof, to a point between the axle 210 of one arm 206 of each of the first and second link members 202, 204 and the pivot 214 thereof, and is abutted, at the distal end of the second spring portion 222, to a supporting wall surface 226 extending upwardly from each of the front and rear inner peripheral surface 72*c* of the base 72. Each of the plate springs 218 produces an elastic restoring force mainly by the first spring portion 220, the second spring portion 222 and the third spring portion 224, and acts as a compression spring between the inner peripheral surface 72*c* of the base 72 and the arm 206 of each of the first and second link members 202, 204.

Each of the first spring portion 220, the second spring portion 222 and the third spring portion 224 of the plate springs 218 has a flat shape in unloaded condition. The first spring portion 220 extends parallel to one arm 206 of the first or second link member 202, 204 in the unloaded condition. The second spring portion 222 extends along the connecting portion 208 of the first or second link member 202, 204 in the unloaded condition. Thus, the plate spring 218 has substantially the same construction as the plate spring 98 in the second embodiment as described before.

As already described with reference to the plate spring 98 in the second embodiment, when the key top 74 is pushed down, respective spring portions 220, 222 and 224 of the plate spring 218 produce elastic restoring forces in different directions from each other. Thus, the two plate springs 218 load the resultant forces of the elastic restoring forces of spring portions 220, 222 and 224 as biasing forces upon the arms 206 of the first and second link members 202, 204, thereby to urge or bias the key top 74 toward the initial position.

Each of a pair of plate springs 228 according to a modification as shown in FIG. 12 is integrally comprised of a first spring portion 230 extending along the fixed-end side substantially in parallel to the shifting direction of the axle 210 of the first or second link member 202, 204, a second spring portion 232 extending along the free-end side in crossing relationship with the first spring portion 230, and a third spring portion 234 extending between the first and second spring portions 230, 232 in crossing relationship with both portions 230, 232 at respective obtuse angles. Each plate spring 228 is fixed, at the proximal end of the first spring portion 230, to the local concave portion of the front inner peripheral surface 72*c* of the base 72, and is abutted, at an upwardly extending portion 232*a* above the major surface 72*a* of the base 72 at the distal end of the second spring portion 232, to the connecting portion 208 of the first or second link member 202, 204.

Each of the plate springs 228 produces an elastic restoring force mainly through the first spring portion 230, the second spring portion 232 and the third spring portion 234, and acts as a compression spring between the inner peripheral surface 72*c* of the base 72 and the connecting portion 208 of the first or second link member 202, 204. Each of the first spring portion 230, the second spring portion 232 and the third spring portion 234 of the plate spring 228 has a flat shape in an unloaded condition. The first spring portion 230 extends parallel to the opposed inner peripheral surface 72*b* of the base 72 in the unloaded condition. The second spring portion 232 extends along inner peripheral surface 72*c* of the base 72 in the unloaded condition. Thus, the plate springs 228 according to the modification have substantially the same construction as the plate springs 106 in the modification as shown in FIG. 6.

Figure 5:
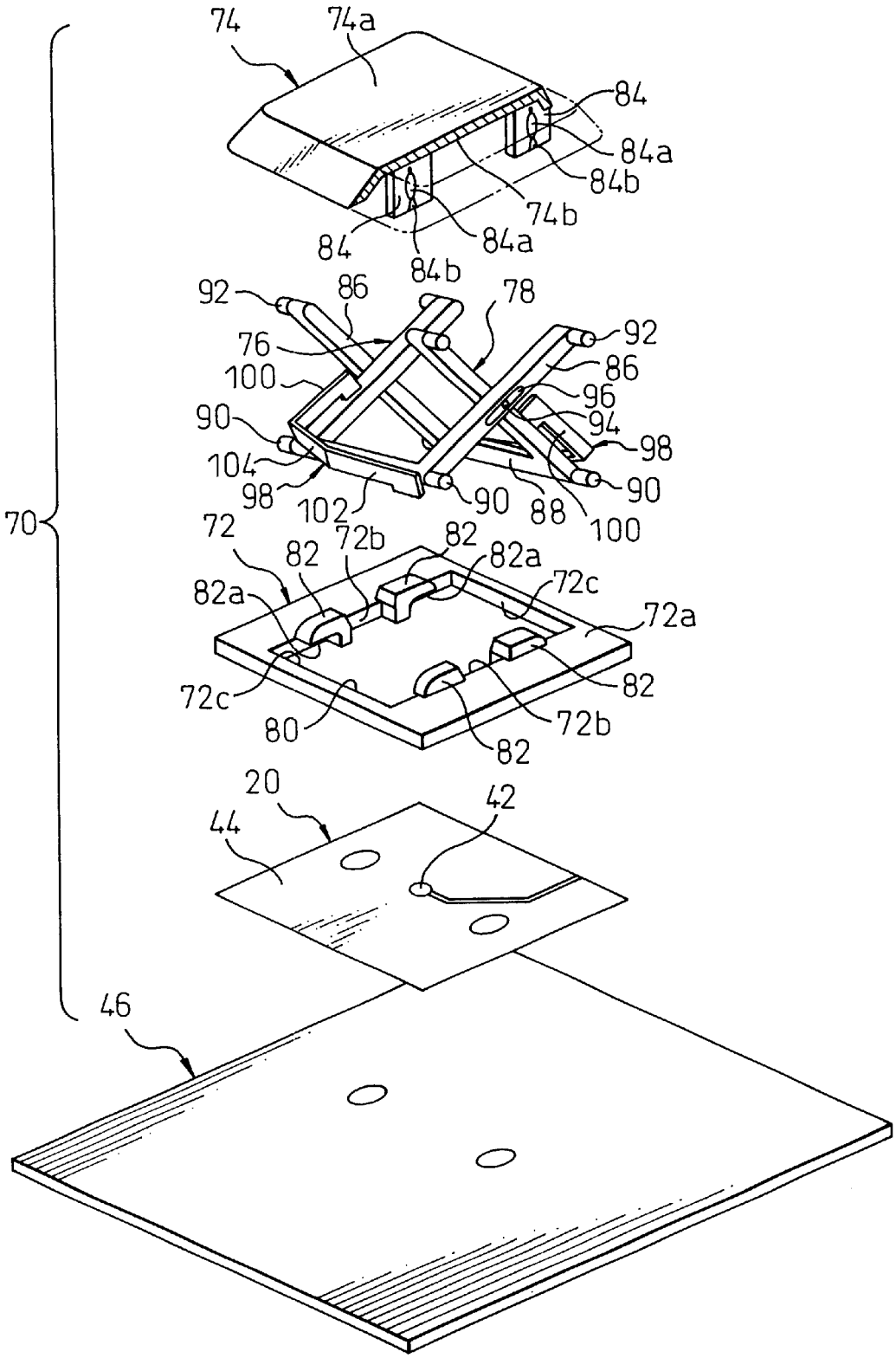
FIG. 5 is an exploded perspective view showing a key switch according to a second embodiment of the present invention.

It will be understood that, with the key switch 200 having the above-described construction, the same operative effect, as with the key switch shown in FIGS. 5 and 6, can be achieved by the characteristic construction of the plate spring 218, 228. It is further possible, with the key switch 200, to obtain an excellent key-entry operating properties as with the key switch 160 of FIGS. 9 and 10.

Figure 13:
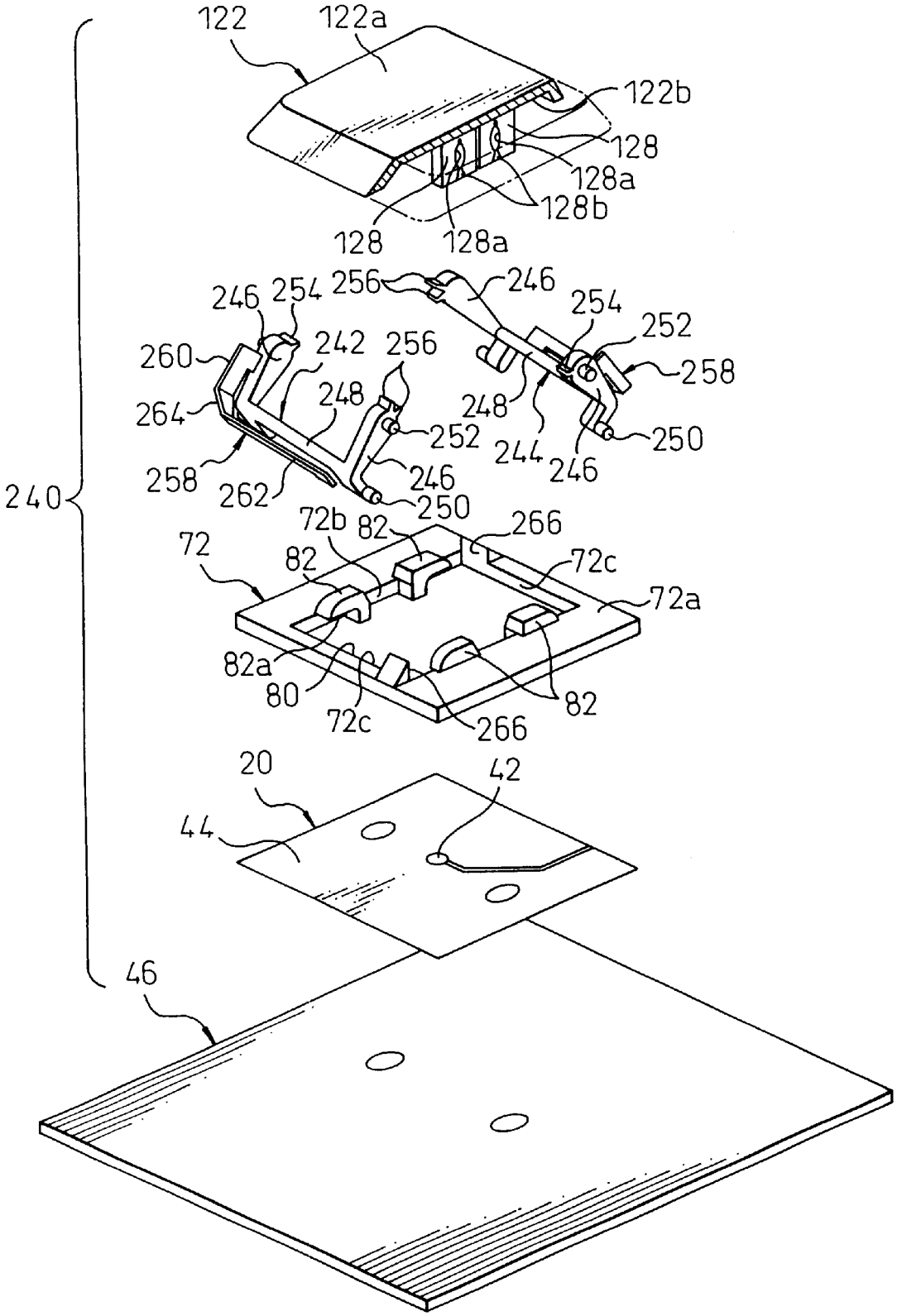
FIG. 13 is an exploded perspective view showing a key switch according to a sixth embodiment of the present invention.
Figure 14:
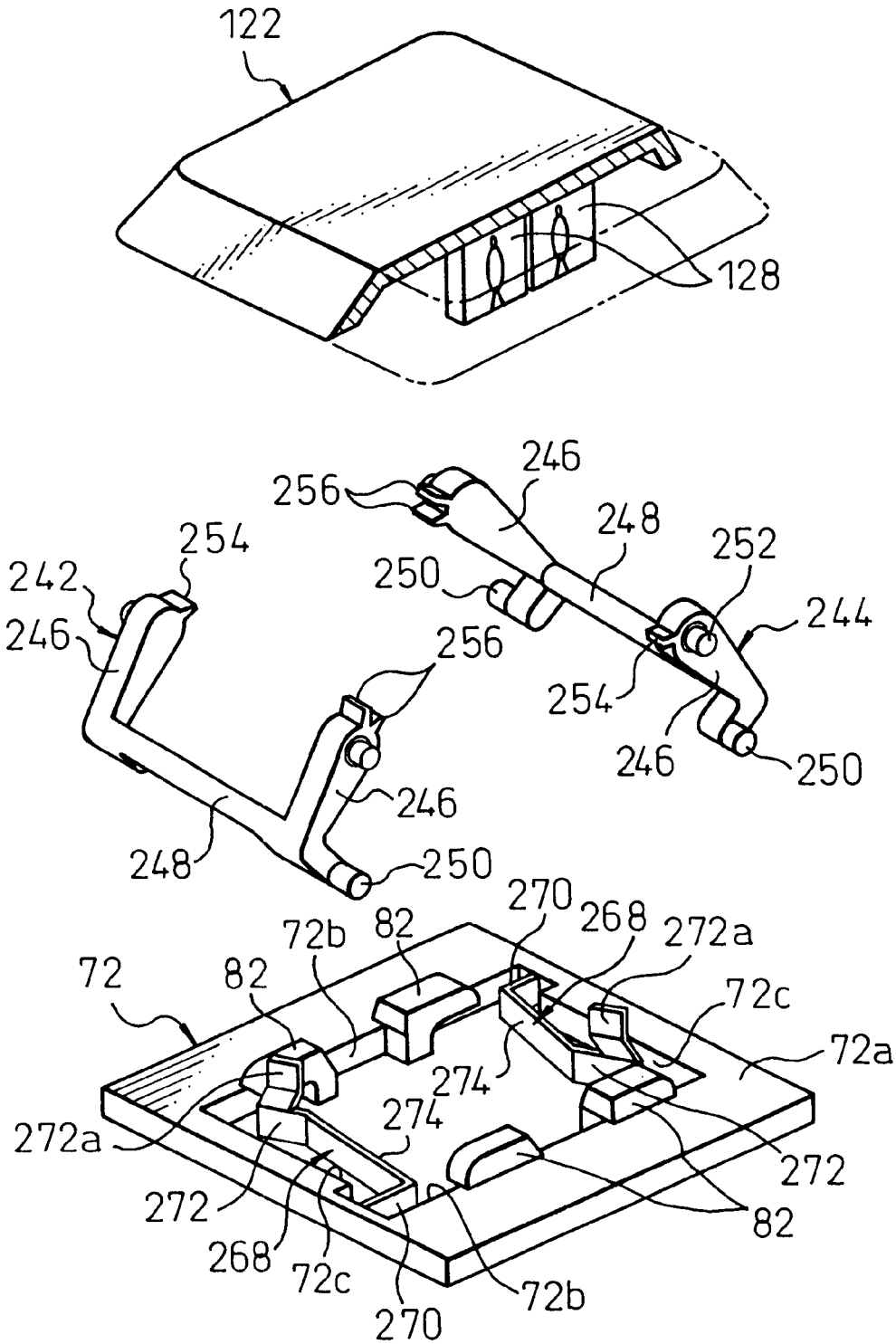
FIG. 14 is an exploded perspective view showing a modification of the key switch of FIG. 13.

FIGS. 13 and 14 show a key switch 240 according to a sixth embodiment of the present invention and its modification, respectively. The key switch 240 has substantially the same construction as the key switch 120 according to the third embodiment except for the difference of the position of the connecting portions in the link members. As the same components are denoted by common reference numerals, detailed descriptions thereof are not repeated.

Thus, the key switch 240 includes a base 72, a key top 122 disposed movably in the vertical or up-and-down direction on a major surface 72*a* of the base 72, a pair of link members 242, 244 for supporting the key top 74 above the base 72 and directing or guiding the key top 122 in the vertical or the up-and-down direction, and a switching mechanism 20 for opening and closing a pair of contacts of an electric circuit in correspondence with the vertical motion of the key top 122.

The pair of link members 242, 244 are structured as a first link member 242 and a second link member 244 which have a mutually substantially identical shape and which are assembled together so as to be provided with a X-shape in a side view. Each of the link members 242, 244 integrally includes two arms 246 extending in parallel to each other and a connecting portion 248 mutually connecting the arms 246 at bent portions near one ends. Axles 250 are provided on the first ends of arms 246 to mutually coaxially project on the opposite sides of the connecting portion 248. Axles 252 are provided on the other ends of the arms 246 to mutually coaxially project on the same side as the axles 250. The first link member 242 and second link member 244 are rotatably connected with each other by intermeshings between one tooth 254 projecting from the distal end, near the axles 252, of the first arms 246 of respective link members and two teeth 256 projecting from the distal end, near axles 252, of the other arms 246 of respective link members.

Such a construction of the first and second link members 242, 244 is substantially the same as that of the first and second link members 124, 126 in the key switch 120 according to the third embodiment except that the position of the connecting portion 248 deviates from the axles 250 by an arbitrary angle about the intermeshings between the teeth 254, 256. Thus, in this embodiment, the axles 250 of the first link member 242 and the axles 250 of the second link member 244 constitute the sliding portions of the link members 242, 244. The first and second link members 242, 244 are interlocked to each other through intermeshings between one tooth 254 and two teeth 256 so as to be synchronously pivotable, whereby the key top 122 is permitted to be subjected to a parallel displacement in a substantially vertical direction in relation to the major surface 72*a* of the base 72, while keeping a predetermined posture of the key top 122 wherein the operation surface 122*a* thereof is generally parallel to the major surface 72*a* of the base 72.

The key switch 240 further includes a pair of plate springs 258 or elastic members, disposed between the base 72 and the first and second link members 242, 244, as biasing means which elastically urge or bias the key top 122 upwardly away from the base 72. Each of the plate springs 258 includes, in an integral manner, a first spring portion 260 extending along a fixed-end side in a direction substantially parallel to the shifting direction of the axle 250 as the sliding portion of the first or second link member 242, 244, a second spring portion 262 extending along a free-end side in a direction intersecting the first spring portion 260, and a third spring portion 264 extending between the first and second spring portions 260, 262 in a direction intersecting both portions 260, 262 at respective obtuse angles.

Each of the plate springs 258 is fixed, at the proximal end of the first spring portion 260 thereof, to a point between two axles 250, 252 of one arm 246 of each of the first and second link members 242, 244, and is abutted, at the distal end of the second spring portion 262, to a supporting wall surface 266 extending upwardly from each of the front and rear inner peripheral surface 72*c* of the base 72. Each plate spring 258 produces an elastic restoring force mainly by the first spring portion 260, the second spring portion 262 and the third spring portion 264, and acts as a compression spring between each inner peripheral surface 72*c* of the base 72 and the arm 246 of each of the first and second link members 242, 244.

Each of the first spring portion 260, the second spring portion 262 and the third spring portion 264 of the plate springs 258 has a flat shape in unloaded condition. The first spring portion 260 extends parallel to one arm 246 of the first or second link member 242, 244 in the unloaded condition. The second spring portion 262 extends along the connecting portion 248 of the first or second link member 242, 244 in the unloaded condition. Thus, the plate spring 258 has substantially same construction as the plate spring 142 in the third embodiment as described before.

As already described with reference to the plate spring 142 in the third embodiment, when the key top 122 is pushed down, respective spring portions 260, 262 and 264 of the plate spring 258 produce elastic restoring forces in different directions from each other. Thus, the two plate springs 258 load the resultant forces of the elastic restoring forces of spring portions 260, 262 and 264 as biasing forces upon the arms 246 of the first and second link members 242, 244, and thereby urge or bias the key top 122 toward the initial position.

Each of a pair of plate springs 268 according to a modification as shown in FIG. 14 is integrally comprised of a first spring portion 270 extending along the fixed-end side substantially in parallel to the shifting direction of the axle 250 of the first or second link member 242, 244, a second spring portion 272 extending along the free-end side in crossing relationship with the first spring portion 270, and a third spring portion 274 extending between the first and second spring portions 270, 272 in crossing relationship with both portions 270, 272 at respective obtuse angles. Each plate spring 268 is fixed, at the proximal end of the first spring portion 270, to the local concave portion of each of the front and rear inner peripheral surfaces 72*c* of the base 72, and is abutted, at an upwardly extending portion 272*a* above the major surface 72*a* of the base 72 at the distal end of the second spring portion 272, to the connecting portion 248 of each of the first and second link members 242, 244.

Each plate spring 268 produces an elastic restoring force mainly through the first spring portion 270, the second spring portion 272 and the third spring portion 274, and acts as a compression spring between each inner peripheral surface 72*c* of the base 72 and the connecting portion 248 of the first or second link member 242, 244. Each of the first spring portion 270, the second spring portion 272 and the third spring portion 274 of the plate spring 268 has a flat shape in an unloaded condition. The first spring portion 270 extends in parallel to an opposed inner peripheral surface 72*b* of the base 72 in the unloaded condition. The second spring portion 232 extends along an inner peripheral surface 72*c* of the base 72 in the unloaded condition. Thus, the plate springs 268 according to the modification have substantially the same construction as the plate springs 150 in the modification as shown in FIG. 8.

It will be understood that, with the key switch 240 having above-described construction, the same operative effect as with the key switch shown in FIGS. 7 and 8 can be achieved by the characteristic construction of the plate springs 258, 268. It is further possible with the key switch 240 to obtain an excellent key-entry operating properties as with the key switch 160 of FIGS. 9 and 10.

Figure 15:
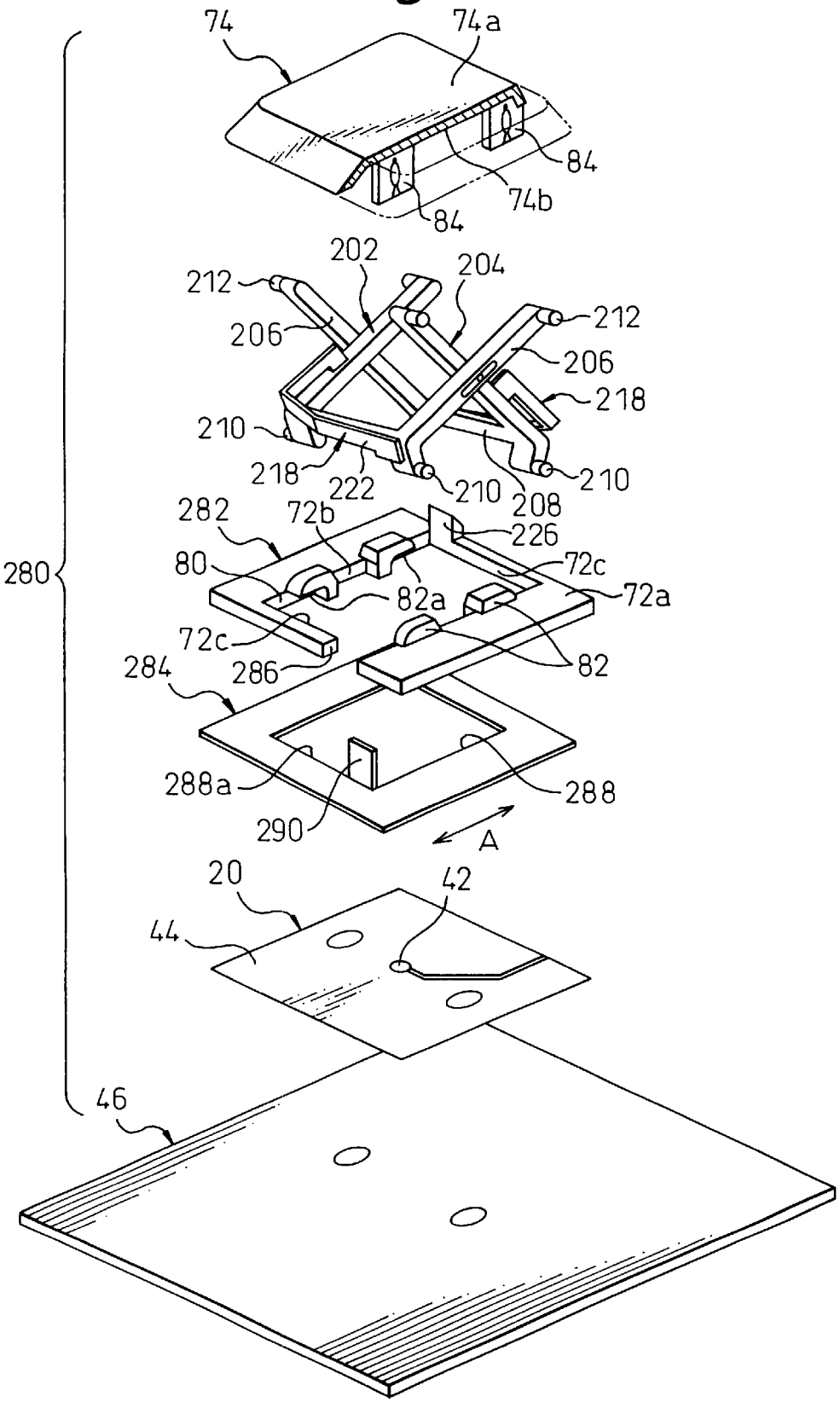
FIG. 15 is an exploded perspective view showing a key switch according to a seventh embodiment of the present invention.
Figure 16:
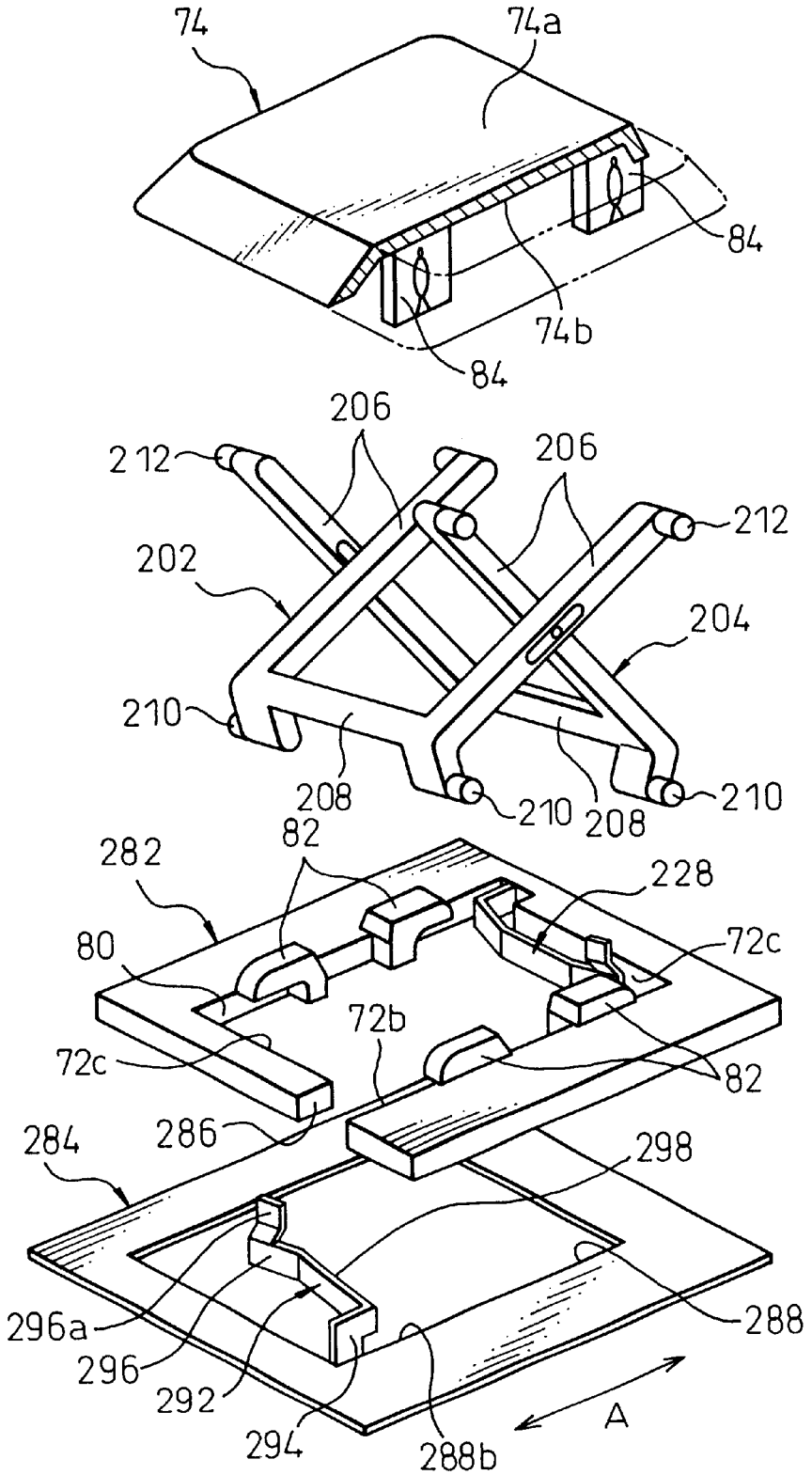
FIG. 16 is an exploded perspective view showing a modification of the key switch of FIG. 15.

FIGS. 15 and 16 show a key switch 280 according to a seventh embodiment of the present invention and its modification, respectively. In the key switch 280, a key top is maintained in a key-entry operable condition when in use and, when not in use, the key top can be positively displaced to a retracted position lower than the initial position, where key-entry operation is not possible. It is possible, by constructing a keyboard incorporating a plurality of such key switches 280, to further improve the portability of a keyboard.

A key switch 280 shown in FIG. 15 employs, in place of the base 72 of the key switch 200 according to the fifth embodiment shown in FIG. 11, a fixed base 282 engaged with a pair of link members 202, 204, and a movable plate 284 movably disposed in relation to the fixed base 282 beneath the fixed base 282. Except for this, the key switch 280 has substantially the same construction including the construction of the plate spring 218 as the key switch 200. As the same components are denoted by common reference numerals, detailed descriptions thereof are not repeated.

The fixed base 282 is a frame-like member which is obtained by removing a frame portion corresponding to the front-side supporting wall surface 226 from the base 72 of the key switch 200 shown in FIG. 11, and except for this, it has substantially the same construction as the base 72. As the same components are denoted by common reference numerals, detailed description thereof are not repeated. Thus, in the fixed base 282, a frame portion corresponding to a part of the front-side inner peripheral surface 72*c* defining the center opening 80 is removed and a cut-out 286 is formed instead.

The movable plate 284 is a frame-like member which constitutes the base of the present invention in cooperation with the fixed base 282, and includes a generally rectangular center opening 288 substantially corresponding to a center opening 80 of the fixed base 282. The movable plate 284 further includes an upright wall 290 integrally joined to a front-side inner edge 288*a* defining the center opening 288. The upright wall 290 projects upwardly through the center opening 80 of the fixed base 282, and is disposed close to the front-side inner peripheral surface 72*c*.

The movable plate 284 can be shifted integrally with the upright wall 290 in a forward/backward direction (shown by an arrow A in the figure) of the key switch 280 between the fixed base 282 and the membrane switch 44. During this operation, the upright wall 290 formed on the movable plate 284 can move in the forward/backward direction through the cut-out formed in the fixed base 282. A pair of plate springs 218 connected to the arms 206 of the first and the second link members 202, 204 act as compression springs between the front-side upright wall 290 of the movable plate 284 and the arm 206 of the first link member 202, and between the rear-side supporting wall surface 226 of the fixed base 282 and the arm 206 of the second link member 204, respectively. Thus, in this embodiment, the plate spring 218 connected to the first link member 202 is abutted at the distal end of the second spring portion 232 to the upright wall 290 of the movable plate 284.

In the key switch 280, it is possible to change the distance between the front and rear supporting wall surfaces that support the pair of plate springs 218 abutted thereto. In normal operation of the key switch 280, such as when using a keyboard comprising a plurality of the key switches 280, for example, the movable plate 284 is placed at the rear end position of the movable range, and the upright wall 290 is fixedly positioned in the center opening 80 of the fixed base 282 at a predetermined distance from the supporting wall surface 226. In this condition, the plate springs 218 keep the key switch 280 in a key-entry operable condition in the same manner as the plate springs 218 of the key switch 200 shown in FIG. 11, and can load an elastic biasing force onto the key top 74.

In an inoperated condition of the key switch 280, such as when carrying a keyboard incorporating a plurality of the key switch 280, for example, the movable plate 284 is displaced forward from the above described position to the front end position of the movable range, and the upright wall 290 is moved, for example, through the cut-out 286 of the fixed base 282 to a position sufficiently separated from the supporting wall surface 226. Accordingly, the first and second link members 202, 204 are automatically folded by their own weight and the weight of the key top 74, since there is no support to the plate spring 218 connected to the first link member 202. As a result, the key top 74 is displaced into the retracted position lower than the initial position. In this state, each of the pair of plate springs 218 is not elastically deformed. Height of the key top 74 in the retracted position is determined by the front end position of the movable range of the upright wall 290 and, hence, of the movable plate 284.

A modification of the key switch 280 shown in FIG. 16 corresponds to the modification shown in FIG. 12, and the plate springs 228 shown in FIG. 12 are connected to the rear inner peripheral surface 72*c* of the fixed base 282. The movable plate 284 includes a plate spring 292 integrally connected to the lateral inner edge 288*b* defining the center opening 288 near the front end. The plate spring 292 is disposed close to the front side inner peripheral surface 72*c* in the center opening 80 of the fixed base 282, opposed to the plate springs 228 on the rear side.

The plate spring 292 is integrally comprised of a first spring portion 294 extending along the fixed-end side substantially in parallel to the shifting direction of the axles 210 of the first link member 202, a second spring portion 296 extending along the free-end side in crossing relationship with the first spring portion 294, and a third spring portion 298 extending between the first and second spring portions 294, 296 in crossing relationship with both portions 294, 296 at respective obtuse angles. The plate spring 292 is fixed, at the proximal end of the first spring portion 294, to the lateral inner edge 288*b* of the movable plate 284, and is abutted, at an upwardly extending portion 296*a* of the distal end of the second spring portion 296, to the connecting portion 208 of the first link member 202.

The plate spring 292 produces an elastic restoring force mainly through the first spring portion 294, the second spring portion 296 and the third spring portion 298, and acts as a compression spring between the movable plate 284 and the connecting portion 208 of the first link member 202. Each of the first spring portion 294, the second spring portion 296 and the third spring portion 298 of the plate spring 292 has a flat shape in an unloaded condition. The first spring portion 294 extends parallel to an opposed inner peripheral surface 72*b* of the fixed base 282 in the unloaded condition. The second spring portion 296 extends along an inner peripheral surface 72*c* of the fixed base 282 in the unloaded condition. Thus, the plate spring 292 according to the modification has substantially the same construction as the plate spring 228 in the modification shown in FIG. 12.

With this modification, in normal operation of the key switch 280, the movable plate 284 is placed at the rear end position of the movable range, and the plate spring 292 is fixedly positioned in the center opening 80 of the fixed base 282 at a predetermined distance from the rear side plate spring 228. During this operation, each of the plate springs 228, 292 keep the key switch 280 in a key-entry operable condition in the same manner as the plate springs 228 of the key switch 200 shown in FIG. 12, and can load an elastic biasing force to the key top 74 in correspondence to a key-entry operation of the key top 74.

In an inoperated condition of the key switch 280, the movable plate 284 is displaced forward from the above described position to the front end position of the movable range, and the plate spring 292 is moved, for example, through the cut-out 286 of the fixed base 282 to a position sufficiently separated from the plate spring 228. Accordingly, the first and second link members 202, 204 are automatically folded by their own weight and the weight of the key top 74, since there is no support to the first link member 202. As a result, the key top 74 is displaced into the retracted position lower than the initial position. In this state, each of the plate springs 228, 292 is not elastically deformed. Height of the key top 74 in the retracted position is determined by the front end position of the movable range of the movable plate 284.

It will be understood that, in the key switch 280 having above-described construction, the same operative effect can be achieved by the characteristic construction of the plate springs 218, 228, 292 as in the key switch 200 shown in FIGS. 11 and 12. It is further possible by constructing a keyboard incorporating a plurality of key switches 280 to achieve a further reduction in the entire height and thereby improve the portability of a keyboard without impairing the key-entry operating properties of the key switch 280.

Figure 17:
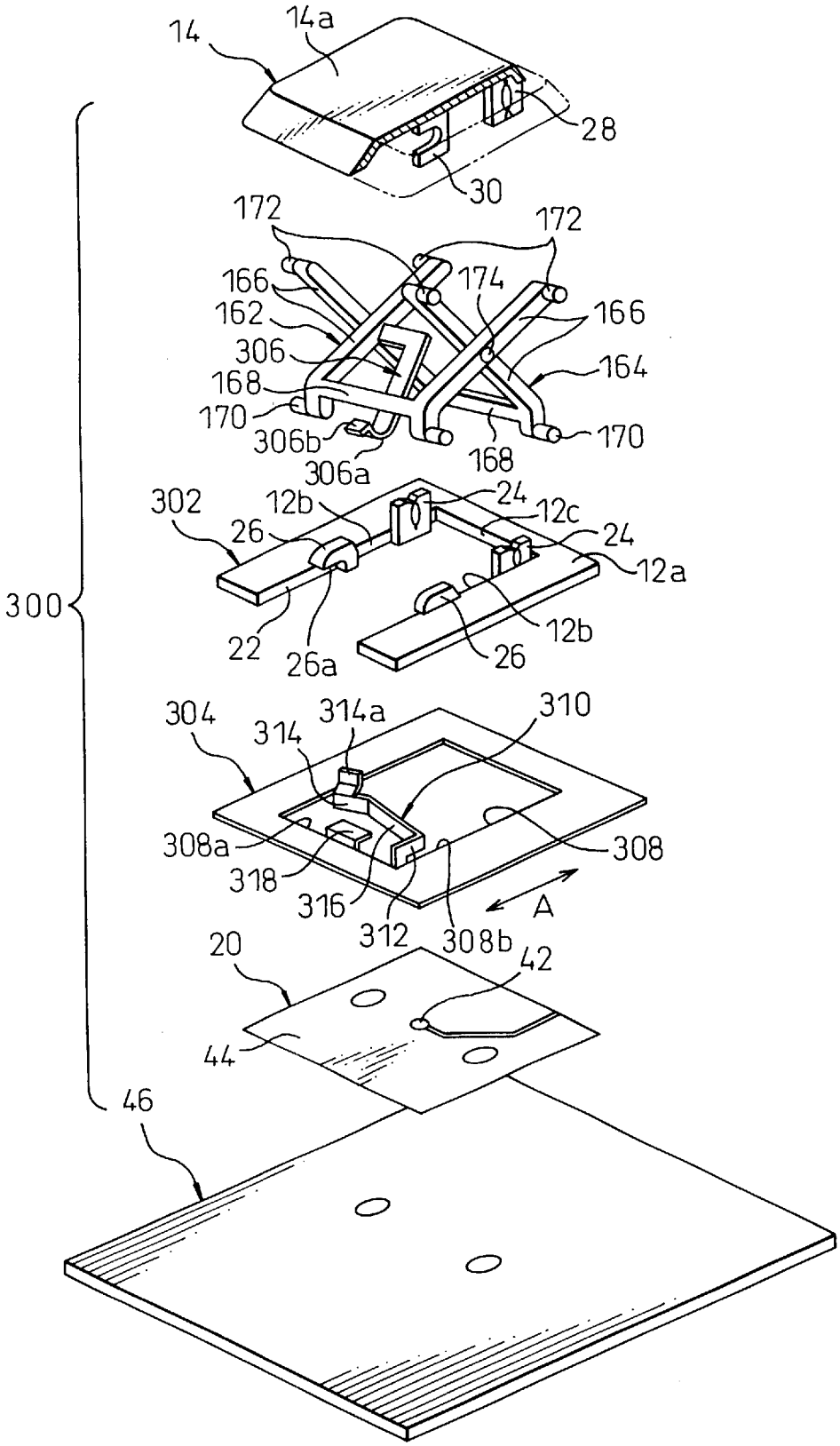
FIG. 17 is an exploded perspective view showing a key switch according to an eighth embodiment of the present invention.

The construction as described above, in which a fixed base and a movable plate are provided to permit the key top to be displaced to a retracted position in an inoperated condition, may be applied to any of the key switches according to the first to sixth embodiments as described before. For example, a key switch 300, according to a eighth embodiment of the present invention shown in FIG. 17, employs, in place of the base 12 in the key switch 160 according to a modification of the fourth embodiment shown in FIG. 10, a base consisting of a fixed base 302 engaged to a pair of link members 162, 164, and a movable plate 304 movably disposed in relation to the fixed base 302 beneath the fixed base 302. The key switch 300 further includes, as an actuating member composing a switch mechanism 20 for opening and closing the switch, an actuating member 306 in the form of a plate spring provided integrally with the first link member 162. Construction of the key switch 300 is otherwise substantially the same as the key switch 160. As the same components are denoted by common reference numerals, detailed descriptions thereof are not repeated.

The fixed base 302 is a frame-like member which is obtained by removing a frame portion corresponding to the front inner peripheral surface 12*c* in the base 12 of the key switch 160 shown in FIG. 10, and except for this, it has substantially the same construction as the base 12. As the same components are denoted by common reference numerals, detailed descriptions thereof are not repeated.

The movable plate 304 is a frame-like member which cooperates with the fixed base 302 to constitute the base of the present invention, and includes a generally rectangular center opening 308 substantially corresponding to a center opening 22 of the fixed base 302. The movable plate 304 further includes a plate spring 310 integrally joined to a portion close to the front end of the lateral inner edge 308*b* defining the center opening 308. The plate spring 310 is disposed, in the center opening 22 of the fixed base 302, in opposition to the rear inner peripheral surface 12*c*. The movable plate 304 can be shifted integrally with the plate spring 310 in a forward/backward direction (shown by an arrow A in the figure) of the key switch 300 between the fixed base 302 and the membrane switch 44.

The plate spring 310 includes, in an integral manner, a first spring portion 312 extending along a fixed-end side in a direction substantially parallel to the shifting direction of the axles 170 of the first link member 162, a second spring portion 314 extending along a free-end side in a direction intersecting the first spring portion 312, and a third spring portion 316 extending between the first and second spring portions 312, 314 in a direction intersecting both portions 312, 314 at respective obtuse angles. The plate spring 310 is fixed, at the proximal end of the first spring portion 312, to the lateral inner edge 308*b* of the movable plate 284, and is abutted, at an upwardly extending portion 314*a* of the distal end of the second spring portion 314, to the connecting portion 168 of the first link member 162.

The plate spring 310 produces an elastic restoring force mainly through the first spring portion 312, the second spring portion 314 and the third spring portion 316, and acts as a compression spring between the movable plate 304 and the connecting portion 168 of the first link member 162. Each of the first spring portion 312, the second spring portion 314 and the third spring portion 316 of the plate spring 310 has a flat shape in an unloaded condition. The first spring portion 312 extends parallel to an opposed inner peripheral surface 12*b* of the fixed base 302 in the unloaded condition. The second spring portion 314 extends on the front side of the fixed base 302 in the unloaded condition. Thus, the plate spring 310 has substantially the same construction as the plate spring 186 in the key switch 160 as shown in FIG. 10.

In normal operation of the key switch 300, the movable plate 304 is placed at the rear end position of the movable range, and the plate spring 310 is fixedly positioned in the center opening 22 of the fixed base 302 at a predetermined distance from the rear inner peripheral surface 12*c*. In this condition, the plate spring 310 keeps the key switch 300 in a key-entry operable condition in the same manner as the plate spring 186 shown in FIG. 10, and can load an elastic biasing force onto the key top 14.

In a non-operated condition of the key switch 300, the movable plate 304 is displaced forward from the above described position to the front end position of the movable range, and the plate spring 310 is moved to a position sufficiently separated from the rear side inner peripheral surface 12*c* of the fixed base 302. Accordingly, the first and second link members 162, 164 are automatically folded by their own weight and the weight of the key top 14, since there is no support to the first link member 162. As a result, the key top 14 is displaced into the retracted position lower than the initial position. In this state, the plate spring 310 is not elastically deformed. The height of the key top 14 in the retracted position is determined by the front end position of the movable range of the plate spring 310 and, hence, of the movable plate 304.

The actuating member 306 provided in the key switch 300 is fixedly joined, at one end thereof, to a generally longitudinal center of one arm 166 of the first link member 162 and extends, at the other free end, to close to the connecting portion 168 of the first link member 162. On the free end of the actuating member 306, a pushing-down portion 306*a* with a convex surface facing downward and a distal tongue 306*b* which bends from the pushing-down portion 306*a* and extends generally flat are provided. When the key top 14 is at the initial upper-limit position of the key-entry stroke, the pushing-down portion 306*a* of the actuating member 306 is disposed above the center opening 22 of the fixed base 302. When the key top 14 is pushed down to a predetermined position, the pushing-down portion 306*a* of the actuating member 306 enters into the center opening 22 of the fixed base 302, and its curved outer surface is abutted to the upper surface of the membrane switch 44.

On the other hand, a generally L-shaped assist member 318 is integrally formed on the movable plate 304 at the front inner edge 308*a* defining the center opening 308. The assist member 318 is fixed at one end thereof to the inner edge 308*a* of the movable plate 304, and projects, at the other free end, into the center opening 22 of the fixed base 302 and extends backward to the plate spring 310. The assist member 318 joined to the movable plate 304 is shifted integrally with the movable plate 304 and the plate spring 310 in the forward/backward direction in relation to the fixed base 302, whereby the assist member 318 can move, when the key top 14 is displaced downward to a predetermined position, between a first position where it is engaged with the tongue 306*b* of the actuating member 306 and a second position where it is separated frontward from the tongue 306*b*.

Figure 18A:
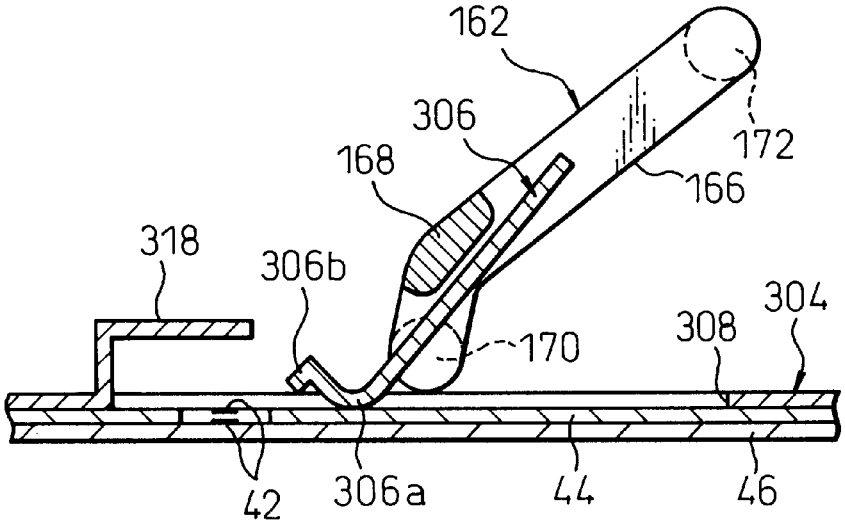
FIGS. 18A to 18C are cross-sectional views for explaining the operational principle of the actuating member in the key switch of FIG. 17.

When the key switch 300 is in a key-entry operable condition, that is, when the movable plate 304 is at the rear limit of the movable range, the assist member 318 is disposed in the above-described first position. In the case where no external force is applied to the key top 14, the plate spring 310 urges or biases the key top 14 through the first and second link members 162, 164 vertically upward away from the fixed base 302 to the initial position, and supports the key top 14 in this position. In this state, the pushing-down portion 306*a* of the actuating member 306 is located above the center openings 22, 308 of the fixed base 302 and the movable plate 304, so as not to contact with the membrane switch 44. The contact 42 of the membrane switch 44 is, as shown in FIG. 18A, located beneath the assist member 318 joined to the movable plate 304.

Figure 18B:
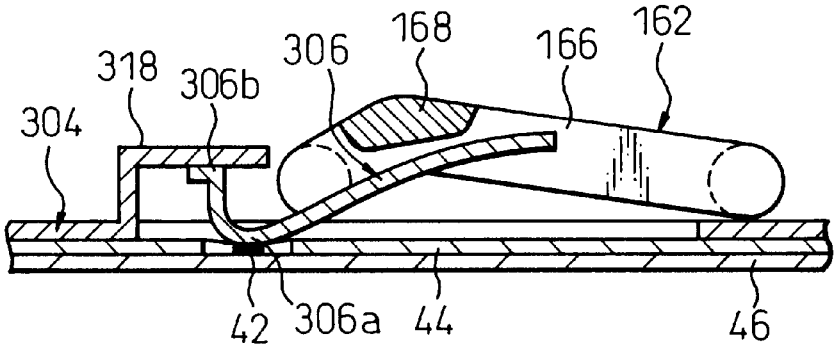

When the key top 14 is pushed down by a key-entry operation, the plate spring 310 is deformed while exerting a biasing or elastic restoring force to the connecting portion 168 of the first link member 162 in a direction generally orthogonal to the pushed-down direction of the key top 14. When the key top 14 reaches the predetermined pushed-down position, as shown in FIG. 18A, the pushing-down portion 306*a* of the actuating member 306 enters into the center openings 22, 308 of the fixed base 302 and the movable plate 304, so as to be abutted at the convex outer surface to the surface of the membrane switch 44. When the key top 14 is further pushed down, as shown in FIG. 18B, the tongue 306*b* of the actuating member 306 enters beneath the assist member 318 joined to the movable plate 304 so as to be engaged with the assist member 318. By continued pushing-down of the key top 14, the actuating member 306 is deformed elastically between the arm 166 of the first link member 162 and the assist member 318, and elastically pushes the membrane switch 44 with the pushing-down portion 306*a* so as to close the pair of contacts 42.

Figure 18C:
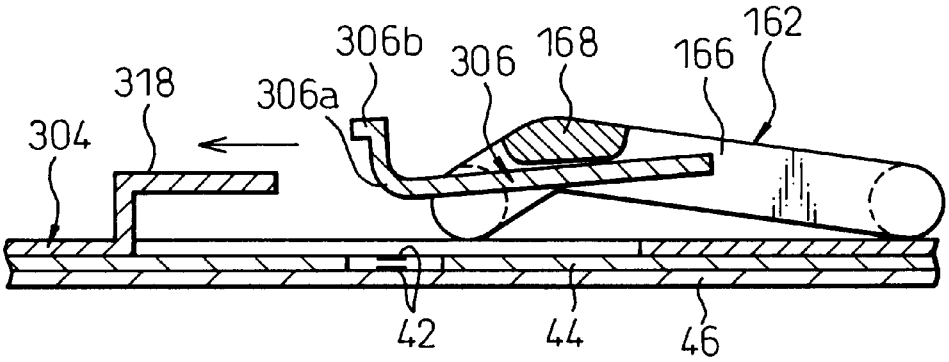

On the other hand, when the movable plate 304 is moved to the front end limit of the movable range, the first and second link members 162, 164 are automatically folded inside the key top 14, and the key top 14 is moved to the retracted position where the key-entry operation is not possible, as described before. In this state, as shown in FIG. 18C, the assist member 318 moves forward with the movable plate 318 and is located at the above-mentioned second position. Therefore, the assist member 318 is not engaged with the tongue 306*b* of the actuating member 306, so that no elastic deformation of the actuating member 306 is produced when the key top 14 is lowered. Also, with the folding of the first link member 162, the tongue 306*b* of the actuating member 306 is located separately above the membrane switch 44, and is not abutted to the membrane switch 44. Thus, the key top 14 can be smoothly displaced to the retracted position without causing the pair of contacts 42 to be closed by the actuating member 306.

It will be understood that, in the key switch 300 having above-described construction, the same operative effect can be achieved by the characteristic construction of the plate spring 310, as in the key switch 160 shown in FIGS. 9 and 10. It is further possible by constructing a keyboard incorporating a plurality of key switches 300 to achieve a further reduction of the entire height and thereby improve the portability of a keyboard without impairing the key-entry operating properties of the key switch 300. The construction of the actuating member 306 for opening/ closing the switch which composes the switching mechanism 20 of the key switch 300 as described above may be applied to any of the key switches according to the first to seventh embodiments as described before.

Figure 19:
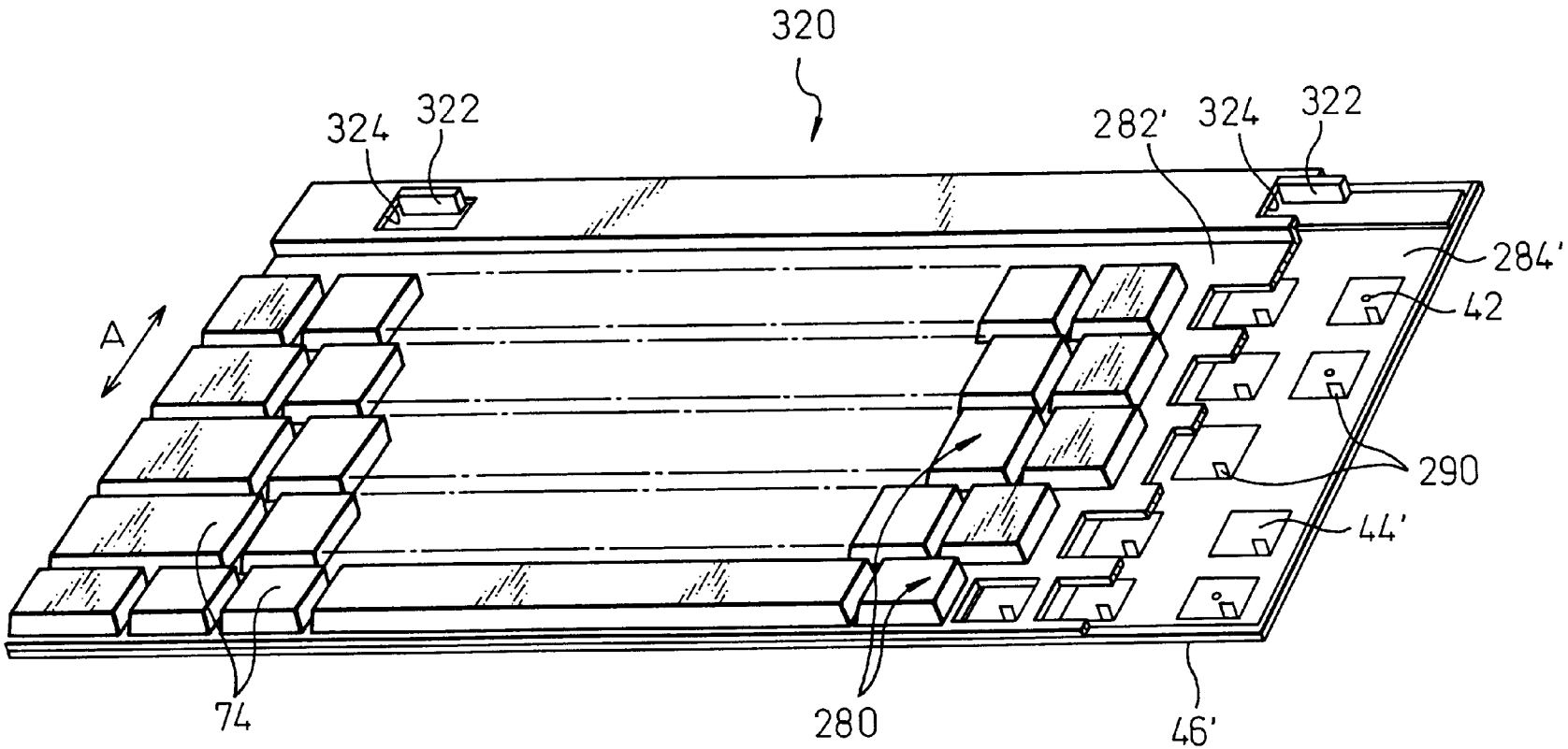
FIG. 19 is a partially cut-away perspective view showing a keyboard according to one embodiment of the present invention, incorporating therein a plurality of key switches according to the present invention.

FIG. 19 shows a keyboard 320 with reduced entire height or thickness according to an embodiment of the present invention that incorporates a plurality of the key switches according to the present invention. The keyboard 320 includes a plurality of the above-described key switches 280 having, as an example, various forms of the key top 74 in a predetermined array. In the keyboard 320, the fixed base 282, the movable plate 284, the membrane switch 44 (or two sheet substrates), and the supporting plate 46 in the key switch 280 are all formed as a fixed base 282', a movable plate 284', a membrane switch 44' and a supporting plate 46', which are enlarged in dimensions so as to be commonly used for all the key switches incorporated into the keyboard 320. The upright wall 290 connected to the movable plate 284' and the contacts 42 of the membrane switch 44' are disposed at the corresponding location in each key switch 280.

The movable plate 284' is provided on the upper surface at the rear end with two protrusions 322 separated from each other, and the fixed base 282' is provided at the rear end with two openings 324 corresponding to the protrusions 322. Each protrusion 322 is received by each opening 324 so as to be movable only in the forward/backward direction (shown by an arrow A). By shifting each protrusion 322 in each opening 324 in the forward/backward direction, the movable plate 284' is shifted in the forward/backward direction accompanied by all upright walls 290, whereby all the key switches 280 are displaced between the projecting position where key-entry operation is possible and the retracted position where key-entry operation is not possible as described before.

Figure 20:
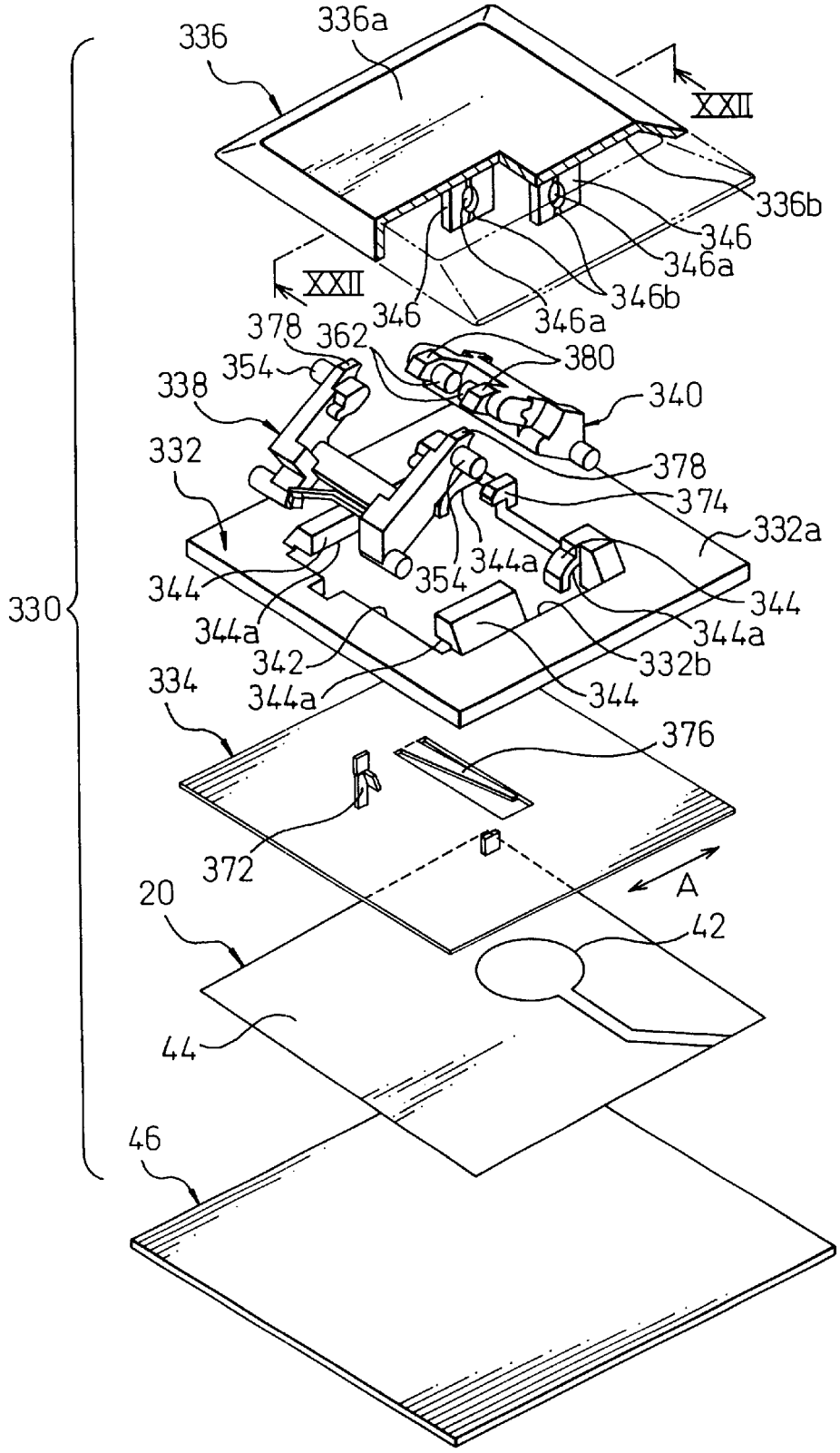
FIG. 20 is an exploded perspective view showing a key switch according to a ninth embodiment of the present invention.

The various key switches according to the various embodiments as described above are constructed such that each of a pair of link members has the axles on one end thereof which are pivotably or slidably engaged with the base, and has the axles on the other end thereof which are pivotably or slidably engaged with the key top, and the pivot supports and slide supports are correspondingly formed in suitable combination both on the base and on the key top as the bearing portions to individually receive the axles on the link members. Thus, if an unnecessary gap is formed between the bearing portion on the key top and the axles on the link member due to the dimensional error in shaping of the key top and the link member, fluctuation of the key top is produced during the key-entry operation, and may result in impairment of the key-entry operating properties. FIG. 20 shows a key switch 330 according to a ninth embodiment of the present invention, which can reduce such a fluctuation of the key top with respect to the link members as far as possible.

The key switch 330 includes a base constituted from a fixed base 332 and a movable plate 334 disposed beneath the fixed base 332 so as to be movable in relation to the fixed base 332, a key top 336 disposed movably in the vertical or up-and-down direction on a major surface 332*a* of the base 332 and having an operation surface 336*a* adapted to be pressed by an operator's finger, a pair of link members 338, 340 for supporting the key top 336 above the base 332 and directing or guiding the key top 336 in the vertical or the up-and-down direction, and a switching mechanism 20 for opening and closing a pair of contacts of an electric circuit in correspondence with the vertical motion of the key top 336. A supporting plate 46 for supporting the switching mechanism 20 and the membrane switch 44 thereof has the same construction as in the key switch 10 of the first embodiment. Therefore, corresponding components are denoted by same reference numerals and detailed descriptions thereof are not repeated.

The fixed base 332 is a frame-like member having a generally rectangular center opening 342 covered with the key top 336. The fixed base 332 is provided, along a pair of opposed inner peripheral surfaces 332*b* thereof defining the center opening 342, with two sets of slide supports 344 spaced apart from each other in a longitudinal or forward/backward direction. Each of the slide supports 344 includes a wall portion projecting from the major surface 332*a* and the inner peripheral surface 332*b* of the fixed base 332, and extends in the form of L. A guiding slot 344*a* extending generally in parallel to the major surface 332*a* is formed inside of the wall portion. Two slide supports 344 which constitute each set are disposed with the respective guiding slots 344*a* in a corresponding position along a pair of inner peripheral surfaces 332*b* of the fixed base 332.

Figure 21:
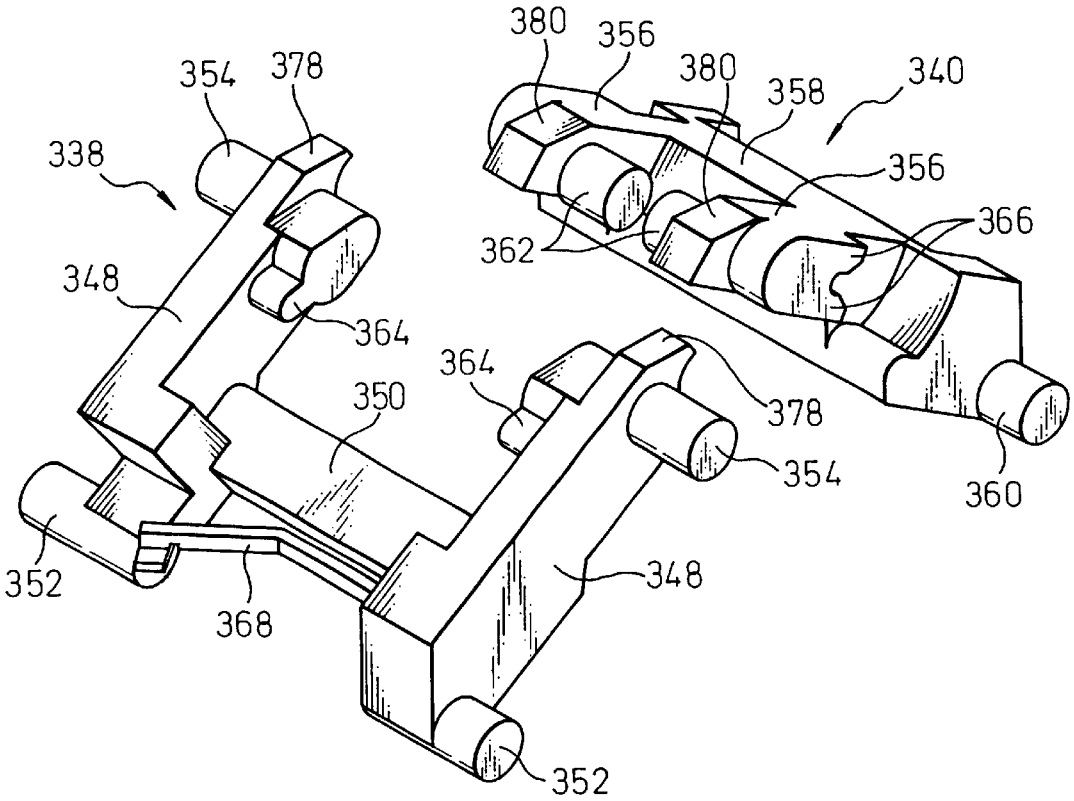
FIG. 21 is an enlarged perspective view showing a link member in the key switch of FIG. 20.

The key top 336 is a dish-like member having a generally rectangular profile, and includes two pairs of pivot supports 346 on an inner surface 336*b* of the key top 336 opposite to the operation surface 336*a* (only two pivot supports 346 are shown in the figure) adjacent to each other generally in the center in the longitudinal or forward/backward direction. A pair of pivot supports 346 are located at a front end side of the key top 336 (a right end side in FIG. 21), and spaced apart from each other, and another pair of pivot supports 346 are located at a rear end side of the key top 346 (a left end side in FIG. 21), and spaced apart from each other.

Each of the pivot supports 346 is formed as a small plate uprightly projecting from the inner surface 336*b* of the key top 336, and includes a bearing hole 346*a* penetrating through the thickness of the plate and a slit 346*b* extending generally perpendicularly to the inner surface 336*b* to communicate with the bearing hole 346*a*. The two pivot supports 346 forming each pair are positioned on the inner surface 336*b* of the key top 336 in such a manner that the bearing hole 346*a* of respective pivot supports 346 are aligned with each other in an axial direction thereof.

The pair of link members 338, 340 are structured as a first link member 338 and a second link member 340, which are assembled together so as to be provided with a X-shape in a side view. As shown in enlarged view in FIG. 21, the first link member 338 includes, in an integral manner, two arms 348 extending in parallel to each other, and a connecting portion 350 connecting the arms 348 to each other. Each of the two arms 348 are provided, on one end thereof, with axles 352 projecting coaxially with each other on opposite sides of the connecting portion 350, and on the other ends of the arms 348, with axles 354 projecting coaxially with each other on the same side as the axles 352. The second link member 340 is integrally comprised of two arms 356 extending in parallel to each other, and a connecting portion 358 connecting the arms 356 to each other. Each of the two arms 356 are provided, on one end thereof, with axles 360 projecting coaxially with each other on opposite side of the connecting portion 358 and, on the other ends of the arms 356, with axles 362 projecting coaxially with and opposed to each other.

Each of the pair of arms 348 of the first link member 338 is provided, on the opposite side of the axles 354, with a tooth 364 extending toward the connecting portion 350, and each of the pair of arms 356 of the second link member 340 is provided, on the opposite side of the axles 362, with two teeth 366 extending toward the axles 360. The first link member 338 and the second link member 340 are pivotably interlocked to each other by intermeshings between one tooth 364 and two teeth 366 of the corresponding arms 348, 356.

The axles 352 formed on the first ends of the arms 348 of the first link member 338 are slidably fitted or received in the respective bearing slots 344*a* of the slide supports 344 on the front side of the fixed base 332, and the axles 354 formed on the other ends of the arms 348 of the first link member 338 are pivotably fitted or received in the bearing hole 346*a* of the pivot supports 346 on the rear side of the key top 336, whereby the first link member 338 is arranged between the fixed base 332 and the key top 336 in such a manner as to be pivotable about the axles 354. The axles 360 formed on the first ends of the arms 356 of the second link member 340 are slidably fitted or received in the respective bearing slots 344*a* of the slide supports 344 on the rear side of the fixed base 332, and the axles 362 formed on the other ends of the arms 356 of the second link member 340 are pivotably fitted or received in the respective bearing holes 346*a* of the pivot supports 346 on the front side of the key top 336, whereby the second link member 340 is arranged between the fixed base 332 and the key top 336 in such a manner as to be pivotable about the axles 362. The first and second link members 338, 340 are interlocked to each other between the fixed base 332 and the key top 336 through intermeshings between one tooth 364 and two teeth 366, so as to be synchronously pivotable, whereby the key top 336 is permitted to be subjected to a parallel displacement in a substantially vertical direction in relation to the major surface 332*a* of the fixed base 332, while keeping a predetermined posture of the key top 336 wherein the operation surface 336*a* thereof is generally parallel to the major surface 332*a* of the fixed base 332.

The key switch 330 further includes plate springs 368 and 370, disposed between the movable plate 334 and the first link member 338, and between the fixed base 332 and the second link member 340, respectively, which act as biasing means for elastically urging the key top 336 upwardly away from the fixed base 332. The plate spring 368 is integrally connected, at one end thereof, to one arm 348 of the first link member 338 to extend along the connecting portion 350, and is abutted, at the other free end, to a spring support 372 projecting from the movable plate 334. The plate spring 370

(see FIG. 22A) is integrally connected, at one end thereof, to one arm 356 of the second link member 340 to extend along the connecting portion 358, and is abutted, at the other free end, to a spring support 374 projecting from the fixed base 332.

The movable plate 334 can move in the forward/backward direction of the key switch 330 (shown by an arrow A in the figure) between the fixed base 332 and the membrane switch 44. Therefore, the spring support 372 projecting from the movable plate 334 can move in the forward/backward direction integrally with the movable plate 334 in relation to the fixed base 332. The plate spring 368 connected to the first link member 338 acts selectively, depending upon the displaced position of the movable plate 334, and hence of the spring support 372, as a compression spring between the first link member 338 and the movable plate 334. In the same manner, the plate spring 370 connected to the second link member 340 acts selectively, depending upon the displaced position of the movable plate 334, and hence of the spring support 372, as a compression spring between the second link member 340 and the fixed base 332. With the key switch having such a construction, it is possible, by shifting the movable plate 334 and thereby changing the distance between two spring supports 372, 374, to displace the key top 336 between an initial projecting position where key-entry operation is possible and a retracted position where key-entry operation is not possible.

When the key top 336 is in a key-entry operable condition, the initial upper limit position of the key-entry stroke of the key top 336 is defined by the moment when the relative approaching motion of the axles 352 on the slide side of the first link member 338 and the axles 360 on the slide side of the second link member 340 is hindered by the wall portion defining the bearing slot 344*a* of the slide supports 344 of the fixed base 332.

The key switch 330 further includes an actuating member 376 of a cantilever spring type, which is integrally provided on the movable plate 334 as an actuating member for pushing the contacts 42 of the membrane switch 44. As described above, when the movable plate 334 is in a position where the key switch 330 is held in the key-entry operable condition, the actuating member 376 is disposed beneath the connecting portion 358 of the second link member 340, and the free end of the actuating member 376 is located above the contacts 42 of the membrane switch 44 (see FIG. 22A). When the key top 336 is pushed down in this condition by a key-entry operation, the connecting portion 358 of the second link member 340 pushes the actuating member 376, whereby the free end of the actuating member 376 pushes the contacts 42 to close (see FIG. 22C). When the movable plate 334 is shifted so as to make the key-entry operation of the key switch impossible, the actuating member 376 is shifted from the position between the connecting portion 358 of the second link member 340 and the contacts 42 of the membrane switch 44 to the outside. As a result, the actuating member 376 no longer pushes the contacts 42 of the membrane switch 44 even if the key top 336 is moved downward.

While the key switch 330 constructed as described above maintains, in normal operation, the key top in the key-entry operable condition, it may positively displace the key top, when not in use, to a retracted position lower than the initial position so as to make the key-entry operation impossible. Thus, if a keyboard is constructed incorporating a plurality of the key switches 330 as shown in FIG. 19, the portability of a keyboard can be significantly improved.

As a characteristic construction of the key switch 330, the first link member 338 includes, at the respective distal ends of the pair of arms 348 and adjacent to the axles 354 pivotably engaged with the key top 336, extensions 378 extending in a direction generally orthogonal to the axles 354. The extensions 378 extend along a pair of pivot supports 346 of the key top 336 in which adjacent axles 354 are supported, and are located, when the key top 336 is in the initial upper limit position of the key-entry stroke, closer to the inner surface 336*b* of the key top 336 than the axles 354. In the same manner, the second link member 340 includes, at the respective distal ends of the pair of arms 356 and adjacent to the axles 362 pivotably engaged with the key top 336, extensions 380 extending in a direction generally orthogonal to the axles 362. The extensions 380 extend along a pair of pivot supports 346 of the key top 336 in which adjacent axles 362 are supported, and are located, when the key top 336 is in the initial upper limit position of the key-entry stroke, closer to the inner surface 336*b* of the key top 336 than the axles 362.

Figure 22A:
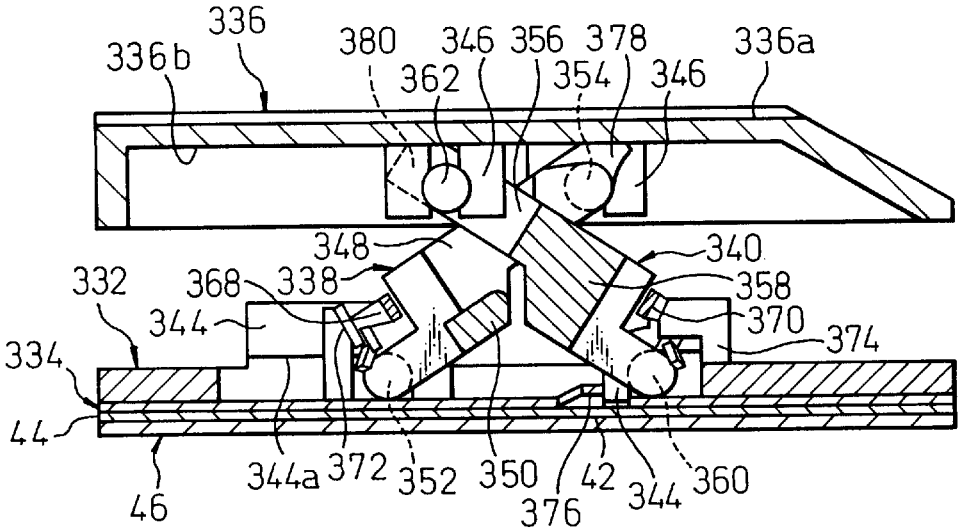
FIGS. 22A to 22C are cross-sectional views taken along the line XXII—XXII of the key switch of FIG. 20, respectively showing the upper limit position of the vertical stroke of the key top, the intermediate position of the vertical stroke of the key top, and the lower limit position of the vertical stroke of the key top.

As shown in FIG. 22A, the key switch 330 is constructed such that, when the key top 336 is in the initial upper limit position of the key-entry stroke, a pair of extensions 378 of the first link member 338 and a pair of extensions 380 of the second link member 340 are substantially in contact with or capable of being abutted to the inner surface 336*b* of the key top 336, at respective areas extending wider than a distance between the axles 354 of the first link member 338 and the axles 362 of the second link member 340. Therefore, even if a gap is formed between the bearing holes 346*a* (FIG. 20) of the pivot supports 346 and the axles 354, 362 due to the dimensional error in molding of the key top 336 and the link members 338, 340, the tilting angle produced in the key top 336 by a key-entry operation can be reduced by the interengagement of the extensions 378, 380 of the link members 338, 340 with the inner surface 336*b* of the key top 336.

In order for the extensions 378, 380 of the link members 338, 340 to be effective in reducing such a fluctuation of the key top, it is desirable to design various components such that when the key top 336 reaches the initial upper limit position of the key-entry stroke under the biasing of a pair of plate springs 368, 370 through the link members 338, 340, the extensions 378, 380 just come into contact with the inner surface 336*b* of the key top 336. In this case, it is most advantageous that, by the interengagement of the extensions 378, 380 with the inner surface 336*b* of the key top 336, the key top 336 is raised within the range of the gap between the pivot supports 346 and the axles 354, 362, and the axles 354, 362 are abutted to the lower edge of the bearing holes 346*a* (FIG. 20) of the pivot supports 346. In this state, the key top 336 is supported at the upper limit position of the key-entry stroke by the axles 354, 362 and the extensions 378, 380 of a pair of link members 338, 340, that is, at eight points in total, so that the fluctuation of the key top 336 can be reduced as far as possible.

Even if the dimensional relationship of the various components is such that when the key top 336 reaches the initial upper limit position of the key-entry stroke under the biasing of a pair of plate springs 368, 370, a gap is formed between the extensions 378, 380 and the inner surface 336*b* of the key top 336, the extensions 378, 380 of the link members 338, 340 can reduce the fluctuation of the key top 336, provided that the gap formed is smaller than the gap between the pivot supports 346 and the axles 354, 362. In the case where the surface of the extensions 378, 380 that come into contact with the inner surface 336*b* of the key top 336 are formed flat as in the embodiment shown in the drawings, it is still more advantageous since the key top 336 is supported by a surface contact.

Figure 22B:
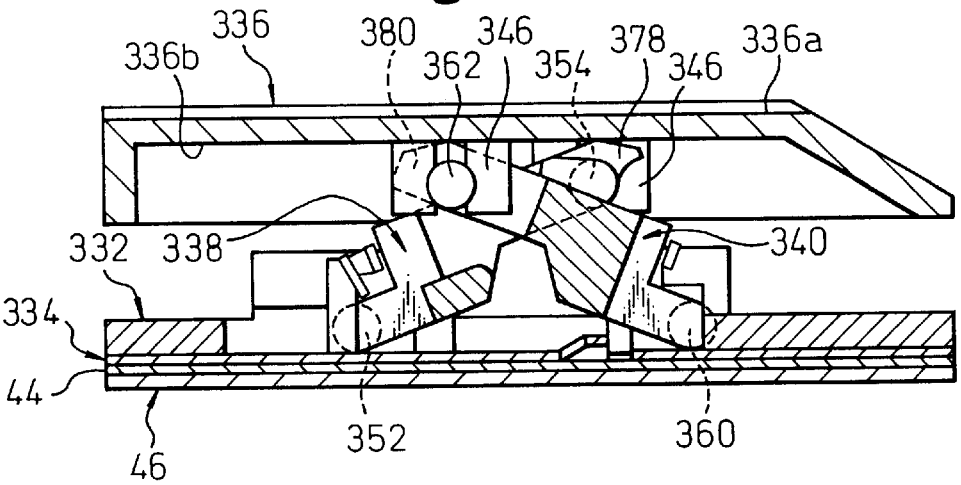
Figure 22C:
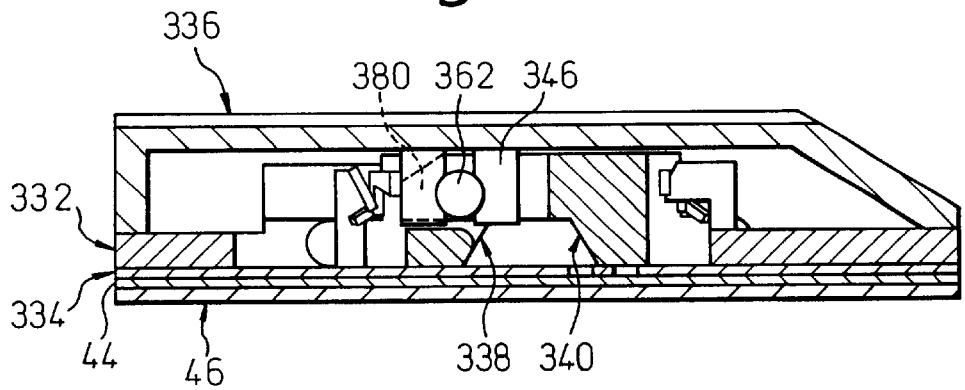

When the key top 336 is not in the upper limit position of the key-entry stroke, as shown in FIGS. 22B and 22C, it is desirable that the extensions 378, 380 of the link members 338, 340 do not come into contact with the inner surface 336*b* of the key top 336 in any position of the key-entry stroke, since smooth pivot motion of the link members 338, 340 and smooth vertical motion of the key top 336 can be thereby achieved. With this construction, if only the unnecessary tilting of the key top 336 at the initial stage of the key-entry operation is avoided, unnecessary tilting of the key top 336 can be substantially eliminated during the subsequent vertical motion of the key top 336, through the cooperation of the pushing-down force loaded to the key top 336 by an operator and the biasing force exerted to the link members 338, 340 by the plate springs 368, 370, so that the contacts 42 of the membrane switch may be correctly closed.

According to the key switch 330 having the above-described construction, when the key top 336 is in the initial upper limit position of the key-entry stroke, the pair of link members 338, 340 can support the key top 336 with the extensions 378, 380 extending into a wider span than the distance between the axles 354, 362, so that the fluctuation of the key top 336 in relation to the link members 338, 340 in the initial stage of the key-entry operation can be reduced as much as possible. In addition, since some dimensional tolerance is accepted for various components, the key-entry operability of the key switch 330 can be improved without requiring high dimensional precision in shaping the key top 336 and the link members 338, 340.

Figure 23:
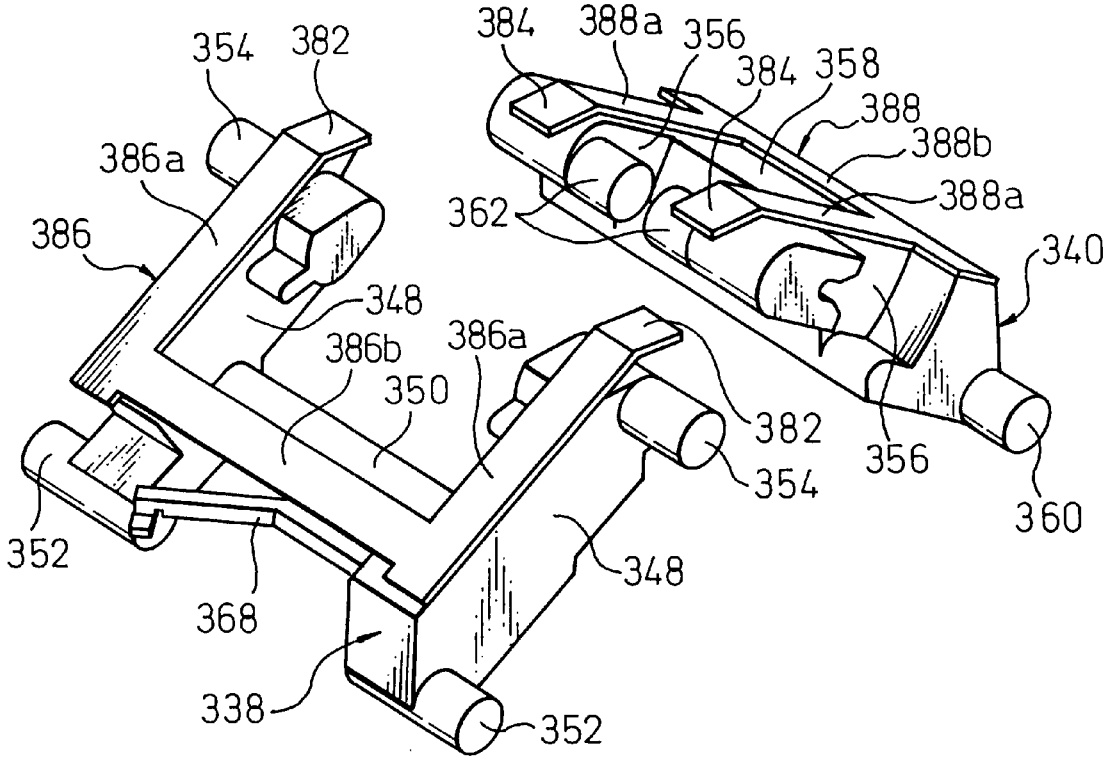
FIG. 23 is an enlarged perspective view showing a link member according to a modification.

FIG. 23 shows a pair of link members 338, 340 respectively including modified extensions 382, 384. The link members 338, 340 have substantially the same construction as the link members 338, 340 in the above embodiment except for the construction of the extensions 382, 384. Therefore, corresponding components are denoted by same reference numerals, and detailed descriptions thereof are not repeated.

The first link member 338 includes, at the respective distal ends of the pair of arms 348 and adjacent to the axles 354 pivotably engaged with the key top 336, extensions 382 made of an elastic material and extending in a direction generally orthogonal to the axles 354. The extensions 382 are constructed as parts of a thin plate member 386, generally U-shaped in plan view, fixed to the first link member 338. The thin plate member 386 includes, in an integral manner, a pair of arm portions 386*a* extending along the surfaces of a pair of arms 348 of the first link member 338 and a connecting portion 386*b* extending along the surface of the connecting portion 350 of the first link member 338. The thin plate member 386 is made of, for example, a metallic material having spring properties, and the distal end region of each arm portion 386*a* projects from the arm 348 to constitute the extension 382. These extensions 382 constructed from the thin plate member 386 extend along a pair of pivot supports 346 of the key top 336 in which respective adjacent axles 354 are supported, and are located closer to the inner surface 336*b* of the key top 336 than the axles 354, when the key top 336 is in the initial upper limit position of the key-entry stroke.

In the same manner, the second link member 340 includes, at the respective distal ends of the pair of arms 356 and adjacent to the axles 362 pivotably engaged with the key top 336, extensions 384 made of an elastic material extending in a direction generally orthogonal to the axles 362. The extensions 384 are constructed as parts of a thin plate member 388, generally U-shaped in plan view, fixed to the second link member 340. The thin plate member 388 includes, in an integral manner, a pair of arm portions 388*a* extending along the surfaces of a pair of arms 356 of the second link member 340, and a connecting portion 388*b* extending along the surface of the connecting portion 358 of the second link member 340. The thin plate member 388 is made of, for example, a metallic material having spring properties, and the distal end region of each arm portion 388*a* projects from the arm 356 to constitute the extension 384. These extensions 384 constructed from the thin plate member 388 extend along a pair of pivot supports 346 of the key top 336 in which respective adjacent axles 362 are supported, and are located closer to the inner surface 336*b* of the key top 336 than the axles 362, when the key top 336 is in the initial upper limit position of the key-entry stroke.

Figure 24:
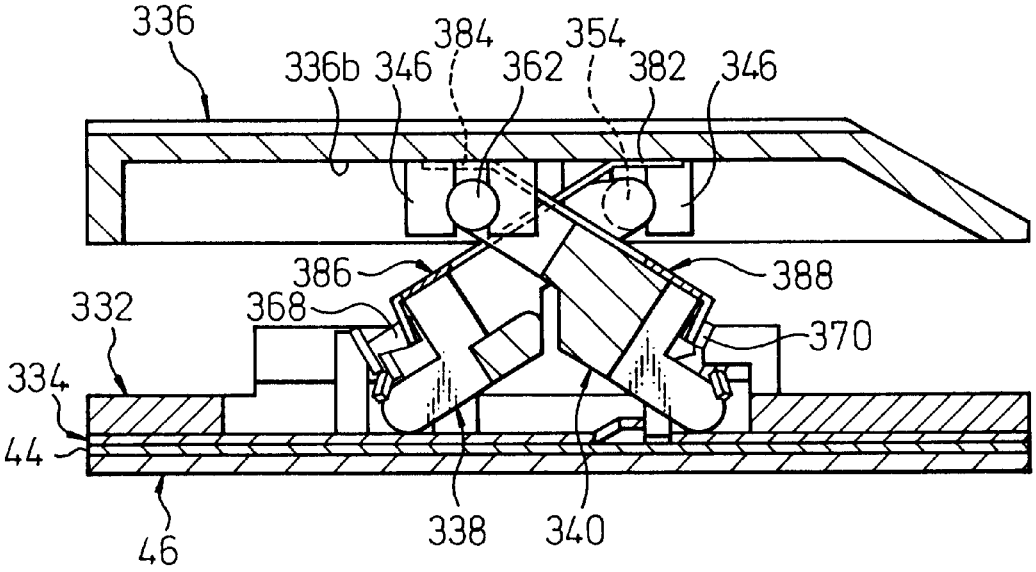
FIG. 24 is a cross sectional view showing a key switch including the link members of FIG. 23 in the upper limit position of the vertical stroke of the key top.

As shown in FIG. 24, the key switch according to the modification is constructed such that, when the key top 336 is in the initial upper limit position of the key-entry stroke, a pair of extensions 382 of the first link member 338 and a pair of extensions 384 of the second link member 340 are substantially in contact with or capable of being abutted to the inner surface 336*b* of the key top 336, at respective areas extending wider than a distance between the axles 354 of the first link member 338 and the axles 362 of the second link member 340. Therefore, even if a gap is formed between the bearing holes 346*a* (FIG. 20) of the pivot supports 346 and the axles 354, 362 due to the dimensional error in molding of the key top 336 and the link members 338, 340, the tilting angle produced in the key top 336 by a key-entry operation can be reduced by the interengagement between the extensions 382, 384 of the link members 338, 340 and the inner surface 336*b* of the key top 336.

Thus, in the same manner as the extensions 378, 380 according to the above described embodiment, the extensions 382, 384 of the link members 338, 340 can reduce the fluctuation of the key top 336 in relation to the link members 338, 340 as far as possible. Particularly, according to this modification, since the extensions 382, 384 are constructed from an elastic material, it is possible to design the thin plate members 386, 388 such that whenever the key top 336 reaches the initial upper limit position of the key-entry stroke under the biasing of the plate springs 368, 370 through the link members 338, 340, the extensions 382, 384 come into contact with the inner surface 336*b* of the key top 336. Thus, even if the extensions 382, 384 come into contact with the key top 336*b* before the key top 336 reaches the upper limit position, it is possible to reliably position the key top 336 in the upper limit position and to secure the normal key-entry stroke provided that the elastic biasing force of the extensions 382, 384 is set smaller than the elastic biasing force of a pair of link members 368, 370. Moreover, the key top 336 is supported at the upper limit position of the key-entry stroke by the axles 354, 362 and the extensions 382, 384 of a pair of link members 338, 340, that is, at eight points in total, so that the fluctuation of the key top 336 can be reduced as much as possible.

The thin plate members 386, 388 including the extensions 382, 384 may be integrally formed together with the plate springs 368, 370 as the biasing means, to thereby reduce the number of parts. Instead of being fixed to the surface of the link members 338, 340, the thin plate members 386, 388 may be embedded in the link members 338, 340, for example, through an insert molding process. In this case, manufacturing process of the link members 338, 340 having the extensions 382, 384 is simplified.

Figure 25:
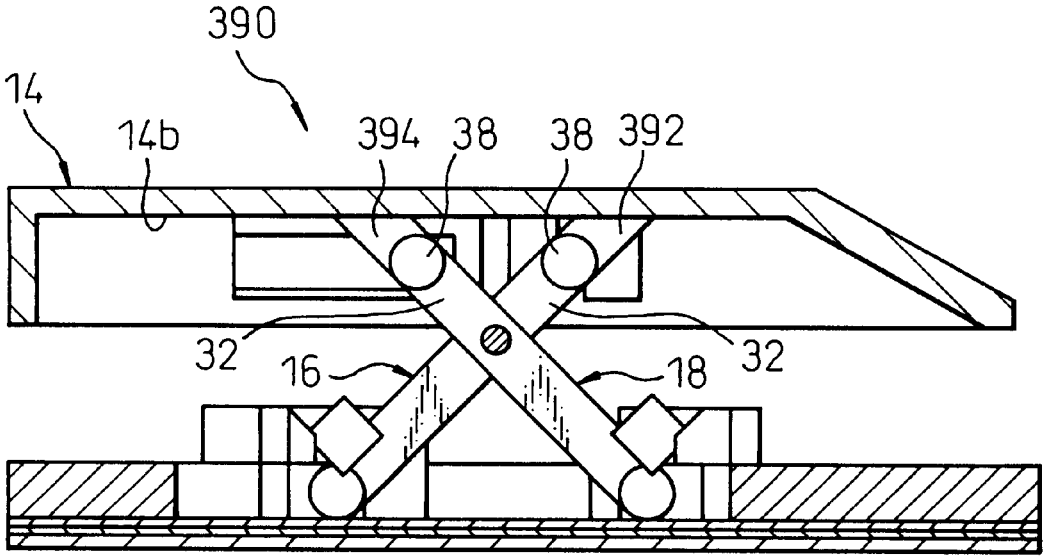
FIG. 25 is a cross sectional view showing a key switch according to a tenth embodiment of the present invention.

The above-described construction to reduce fluctuation of the key top by the extensions provided on each of the pair of link members can be applied to a key switch comprising a pair of link members having the same interlocked structure as, for example, the first and second link members 16, 18 in the embodiment shown in FIG. 1, or the first and second link members 76, 78 in the embodiment shown in FIG. 5. For example, a key switch 390 according to the tenth embodiment of the present invention shown in FIG. 25 has the construction in which an extension 392 extending generally orthogonal to the axles 38 is provided at the distal end of each arm 32 of the first link member 16 shown in FIG. 1, adjacent to the axles 38 pivotably engaged with the key top 14, and an extension 394 extending generally orthogonal to the axles 38 is provided at the distal end of each arm 32 of the second link member 18 shown in FIG. 1, adjacent to the axles 38 slidably engaged with the key top 14. When the key top 14 is in the initial upper limit position of the key-entry stroke, a pair of extensions 392 of the first link member 16 and a pair of extensions 394 of the second link member 18 are substantially in contact with or capable of being abutted to the inner surface 14*b* of the key top 14, at respective areas extending wider than a distance between the axles 38 of the first link member 16 and the axles 38 of the second link member 18. It will be understood that the same operative effect can be achieved with this construction as with the key switch 330 according to the embodiment shown in FIG. 20.

Figure 26:
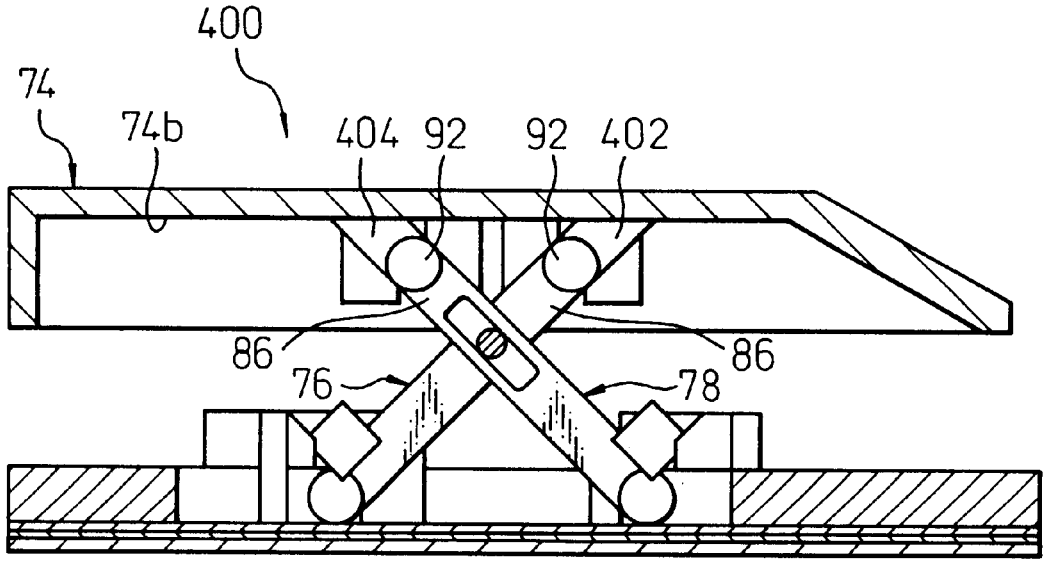
FIG. 26 is a cross sectional view showing a key switch according to an eleventh embodiment of the present invention.

A key switch 400 according to the eleventh embodiment of the present invention shown in FIG. 26 has the construction in which an extension 402 extending generally orthogonal to the axle 92 is provided at the distal end of each arm 86 of the first link member 76 shown in FIG. 5, adjacent to the axle 92 pivotably engaged with the key top 74, and an extension 404 extending generally orthogonal to the axle 92 is provided at the distal end of each arm 86 of the second link member 78, adjacent to the axle 92 pivotably engaged with the key top 74. When the key top 74 is in the initial upper limit position of the key-entry stroke, a pair of extensions 402 of the first link member 76 and a pair of extensions 404 of the second link member 78 are substantially in contact with or capable of being abutted to the inner surface 14*b* of the key top 14, at respective areas extending wider than a distance between the axles 92 of the first link member 76 and the axles 92 of the second link member 78. It will be understood that the same operative effect can be achieved with this construction as with the key switch 330 according to the embodiment shown in FIG. 20.

As is apparent from the above description, the present invention makes it possible to eliminate the dome-shaped elastic actuating member without impairing the characteristic non-linear key-entry operational feelings of a key switch, and to further reduce the entire height of a key switch upon both the non-operated and operated or pushed-down conditions thereof with simple and inexpensive construction and, also, to avoid an unnecessary increase of the biasing force for elastically urging or biasing the key top to the initial position when the size of the key switch is reduced. Moreover, according to the present invention, fluctuation of the key top relative to the link members can be reduced as much as possible without requiring high dimensional precision for the key top and link members of a key switch. Further, according to the present invention, by incorporating a plurality of such key switches, the thickness of a keyboard can be further reduced, and improvements in the portability and in the key-entry operability can be achieved.

While the invention has been particularly shown and described with reference to preferred embodiments thereof, it will be understood by those skilled in the art that various changes and modifications may be made without departing from the spirit and scope of the following claims.

What is claimed is:

1. A key switch comprising:

a base;

a key top arranged above said base;

first and a second link members interlocked to each other and operatively engaged with said base and said key top to support said key top above said base and direct said key top in a vertical direction, said first and second link members including a sliding portion slidably and shiftably engaged with either one of said base and said key top;

at least one plate spring disposed between at least said first link member and either one of said base and said key top with which said sliding portion is engaged, to exert biasing force, relative to a shifting amount of said sliding portion, onto said at least said first link member in a direction different from said vertical direction, said at least one plate spring including, in an integral manner, a first spring portion extending along a fixed-end side in a direction substantially parallel to a shifting direction of said sliding portion of said first link member and a second spring portion extending along a free-end side in a direction intersecting said first spring portion; and a switching mechanism for selectively opening and closing an electric circuit in connection with a vertical movement of said key top.

2. The key switch of claim 1, wherein said at least one plate spring is fixed at a proximal end of said first spring portion to at least said first link member and is abutted at a part of said second spring portion onto said base.

3. The key switch of claim 1, wherein said at least one plate spring is fixed at a proximal end of said first spring portion to said base and is abutted at a part of said second spring portion onto at least said first link member.

4. The key switch of claim 1, wherein said base includes a fixed base element engaged with said first and second link members and a movable base element disposed under said fixed base element in such a manner as to be movable with relation to said fixed base element.

5. The key switch of claim 4, wherein said at least one plate spring is fixed at a proximal end of said first spring portion to at least said first link member and is abutted at a part of said second spring portion onto said movable base element.

6. The key switch of claim 4, wherein said at least one plate spring is fixed at a proximal end of said first spring portion to said movable base element and is abutted at a part of said second spring portion onto at least said first link member.

7. The key switch of claim 1, wherein said first and second link members are arranged to mutually intersect and are pivotably connected relative to each other at an intersection thereof, wherein said first link member is engaged slidably at a first end region thereof with said base and rotatably at a second end region thereof with said key top, said sliding portion being provided on said first end region of said first link member, and wherein said second link member is engaged rotatably at a first end region thereof with said base and slidably at a second end region thereof with said key top, said sliding portion being provided on said second end region of said second link member.

8. The key switch of claim 1, wherein said first and second link members are arranged to mutually intersect and are pivotably and slidably connected relative to each other at an intersection thereof, and wherein said first and second link members are engaged slidably at a first end region thereof with said base and rotatably at a second end region thereof with said key top, said sliding portion being provided on said first end region of each of said first and second link members.

9. The key switch of claim 1, wherein said first and second link members are meshed with each other at a toothed end of said first and second link members, and wherein said first and second link members are engaged slidably at a first end region thereof with said base and rotatably at a second end region thereof with said key top, said sliding portion being provided on said first end region of the first and second link members, said toothed end being provided adjacent to said second end region of the first and second link members.

10. A keyboard comprising a plurality of key switches, each of said key switches being one defined in claim 1.

11. A key switch comprising:

a base;

a key top arranged above said base;

first and second link members interlocked to each other and operatively engaged with said base and said key top to support said key top above said base and direct said key top in a vertical direction, each of said first and second link members including a first axle engaged with said key top and an extension provided adjacent to each said first axle; and a switching mechanism for selectively opening and closing an electric circuit in connection with a vertical movement of said key top;

wherein said first and second link members are arranged in such a manner that, when said key top is in an upper limit position of a key-entry stroke, the extensions provided on said first and second link members are substantially in contact with said key top at respective areas extending wider than a distance between said first axles of said first and second link members.

12. The key switch of claim 11, wherein at least one of said extensions includes an elastic member.

13. The key switch of claim 11, wherein said first and second link members are arranged to mutually intersect and are meshed with each other at an intersection thereof, and wherein said first and second link members are engaged slidably at a first end region thereof with said base and rotatably at a second end region thereof with said key top, a second axle being provided on said first end region of each of said first and second link members, said first axles and said extensions being provided on said second end region of said first and second link members.

14. A keyboard comprising a plurality of key switches, each of said key switches being one defined in claim 11.

15. A key switch, comprising:

a base;

a key top above the base;

a first link member including a sliding portion engaged with one of the base and the key top;

a second link member having a sliding portion engaged with one of the base and the key top, wherein said first and second link members are interlocked and operatively engaged with the base and the key top to support and direct the key top relative to the base in a first direction;

a plate spring, disposed between the first link member and either one of the base and the key top with which the sliding portion is engaged, that exerts a biasing force onto the first link member in a second direction different from the first direction; and a switch that opens and closes an electric circuit in connection with movement of the key top in the first direction.

16. The key switch of claim 15, wherein the plate spring is fixed at a proximal end thereof to at least the first link member and another end abuts the base.

17. The key switch of claim 15, wherein the plate spring is fixed at a proximal end thereof to the base and another end abuts the first link member.

18. The key switch of claim 15, wherein the base includes a fixed base element engaged with the first and second link members and a movable base element disposed under the fixed base element in such a manner as to be movable with relation to the fixed base element.

19. The key switch of claim 15, wherein the first and second link members are arranged to mutually intersect and are pivotably connected relative to each other at an intersection thereof, wherein the first link member is engaged slidably at a first end region thereof with the base and rotatably at a second end region thereof with the key top, the sliding portion being provided on the first end region of the first link member, and wherein the second link member is engaged rotatably at a first end region thereof with the base and slidably at a second end region thereof with the key top, the sliding portion being provided on the second end region of the second link member.

20. A keyboard comprising a plurality of key switches, each of said key switches being one defined in claim 15.

* * * * *